US008955966B2

(12) United States Patent
Norikane et al.

(10) Patent No.: US 8,955,966 B2
(45) Date of Patent: Feb. 17, 2015

(54) RECORDING APPARATUS

(71) Applicants: Shunsuke Norikane, Nagoya (JP); Masayuki Okumura, Nagoya (JP)

(72) Inventors: Shunsuke Norikane, Nagoya (JP); Masayuki Okumura, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/192,018

(22) Filed: Feb. 27, 2014

(65) Prior Publication Data

US 2014/0240429 A1 Aug. 28, 2014

(30) Foreign Application Priority Data

Feb. 28, 2013 (JP) ..... 2013-040077

(51) Int. Cl.

| | |
|---|---|
| ***B41J 2/01*** | (2006.01) |
| ***B41J 13/26*** | (2006.01) |
| ***B41J 11/00*** | (2006.01) |
| *B65H 20/00* | (2006.01) |
| *B65H 9/00* | (2006.01) |
| *B65H 5/12* | (2006.01) |
| *B41J 13/02* | (2006.01) |
| *B41J 13/08* | (2006.01) |

(52) U.S. Cl.

CPC ..... *B41J 13/26* (2013.01); *B41J 11/0055* (2013.01); *B41J 11/006* (2013.01); *B41J 13/02* (2013.01)

USPC ..... 347/104; 226/190; 226/193; 400/641; 271/226; 271/268

(58) Field of Classification Search

CPC ..... B41J 11/06; B41J 7/0085; B41J 7/0045; B41J 13/02; B65H 29/02; B65H 29/42; B65H 240/00; B65H 240/10; B65H 240/111; B65H 240/1115; B65H 240/1116; B65H 240/1118; B65H 240/1119; B65H 240/65

USPC ..... 347/104; 226/190, 193; 400/641; 271/226, 268

See application file for complete search history.

(56) References Cited

U.S. PATENT DOCUMENTS

| | | | | |
|---|---|---|---|---|
| 5,850,233 | A | 12/1998 | Otsuka et al. | |
| 5,912,690 | A | 6/1999 | Endo et al. | |
| 2014/0240428 | A1 * | 8/2014 | Norikane | 347/104 |
| 2014/0240429 | A1 | 8/2014 | Norikane et al. | |

FOREIGN PATENT DOCUMENTS

| | | |
|---|---|---|
| JP | H03293136 | 12/1991 |
| JP | H10129911 | 5/1998 |
| JP | H11130299 | 5/1999 |
| JP | 2007-161361 | 6/2007 |

* cited by examiner

*Primary Examiner* — Laura Martin
*Assistant Examiner* — Jeremy Bishop
(74) *Attorney, Agent, or Firm* — Frommer Lawrence & Haug LLP

(57) ABSTRACT

There is provided a recording apparatus including a recording section and a transport mechanism, which has a guide surface, a driving roller, and a driven spur. A length X (mm) of a front end surface of the driven spur and an angle Y of the driven spur are configured to be within a first area surrounded by a mathematical expression 1 which is X>0, a mathematical expression 2 which is Y>0, a mathematical expression 3 which is Y=40.1X+1.6, a mathematical expression 4 which is Y=−9.0X+5.6, a mathematical expression 5 which is Y=−12.1X+6.0, and a mathematical expression 6 which is Y=−14.7X+7.1.

5 Claims, 8 Drawing Sheets

MOVING LOCUS OF EACH TOOTH
72a
P
N1
N2
DIRECTION OF AXIS L1
DIRECTION J
50
L1
L2
71
72
74
J
54a
63
M
T
SUBSIDIARY SCANNING DIRECTION
MAIN SCANNING DIRECTION
61
77

RECORDING APPARATUS

CROSS REFERENCE TO RELATED APPLICATION

The present application claims priority from Japanese Patent Application No. 2013-040077, filed on Feb. 28, 2013, the disclosure of which is incorporated herein by reference in its entirety.

BACKGROUND OF THE INVENTION

1. Field of the Invention

The present invention relates to a recording apparatus recording an image.

2. Description of the Related Art

There is known a roller pair which performs registration of a recording medium such as a sheet material by making the recording medium along a guide surface as a reference wall. The roller pair includes a transport roller and an skew roller. A rotational shaft of the transport roller is perpendicular to the guide surface, and the transport roller transports the recording medium in a transport direction. The skew roller has an outer circumferential surface in a columnar shape. The skew roller rotates in association with the transport of the recording medium and has a rotational shaft which is inclined with respect to the rotational shaft of the transport roller so that the recording medium can be drawn to the side of the guide surface. This construction enables the registration of the recording medium.

There is also known an skew roller pair with a spur which performs the registration of the recording medium by making the recording medium along the guide surface. The spur is used for the skew roller pair with the spur, instead of the skew roller forming the above roller pair.

In the registration of the recording medium, the roller pair causes the skew roller to move the recording medium to the guide surface, even when the end surface of the recording medium is brought into contact with the guide surface. In this situation, although the thrust load is applied on the skew roller owing to the contact between the guide surface and the recording medium, the recording medium is easy to slide on the skew roller, in other words, the recording medium is more likely to move in a direction away from the guide surface. Thus, occurrence of a jam of the recording medium can be suppressed. However, the skew roller scrapes an image recorded on the recording medium when the recording medium slides on the skew roller, and thus any image defect problem may occur. Further, in the case that the image recorded on the recording medium makes contact with the skew roller, a recording material for forming the image is adhered to the outer circumferential surface of the skew roller, which may cause a problem that the recording material adhered to the skew roller is transferred to the recording medium to make the recording medium dirty.

Meanwhile, in the case that the spur is used instead of the skew roller as described above, since the spur has teeth each having a very small contact area with the recording medium as compared with the skew roller, it is possible to prevent the recording medium from getting dirty. However, the teeth of the spur function as spikes to stick in the surface of the recording medium in the registration of the recording medium. Thus, even when the thrust load is applied on the spur due to the contact between the guide surface and the end surface of the recording medium, the recording medium hardly slides on the spur. As a result, the jam of the recording medium may occur.

SUMMARY OF THE INVENTION

An object of the present teaching is to provide a recording apparatus which is capable of suppressing occurrence of a jam of a recording medium and dirt in the recording medium.

According to an aspect of the present teaching, there is provided a recording apparatus configured to discharge a liquid to a recording medium to perform recording thereon, including: a recording section configured to discharge the liquid; and a transport mechanism configured to transport the recording medium for which an image is recorded by the liquid discharged from the recording section.

The transport mechanism includes:

a guide surface extending linearly and configured to guide one of both side ends of the recording medium transported;

a driving roller configured to make contact with a surface, of the recording medium, on which no image is recorded and transport the recording medium; and a driven spur configured to make contact with a surface, of the recording medium, on which the image is recorded so that the recording medium is nipped between the driven spur and the driving roller, and including at least one spur which is configured to rotate in association with the transport of the recording medium by rotation of the driving roller.

Each of the at least one spur includes a plurality of teeth protruding in a first direction, which is perpendicular to an axis of a rotational shaft of the driven spur as viewed from a direction of the axis, and aligned and arranged in a circumferential direction with the axis of the driven spur as a center. Each of the teeth includes two side surfaces and a front end surface, each of the two side surfaces inclining to come closer to an imaginary line perpendicular to the axis at positions, which are disposed nearer to a tooth tip of each of the teeth from a base of each of the teeth, as viewed from the direction of the axis, the front end surface being formed at a position closer to the axis than a line of intersection of two imaginary planes extending along the two side surfaces. In a graph, in which a length X (mm) of the front end surface in a second direction, which is an in-plane direction of the front end surface and is perpendicular to both of the direction of the axis and the first direction, is a horizontal axis and an angle Y (degree) between the axis and the imaginary line perpendicular to the guide surface passing through a point of intersection between the axis and the guide surface is a vertical direction, the length X of the front end surface of the driven spur and the angle Y of the driven spur are configured to be within a first area surrounded by mathematical expressions 1 to 6 described below.

The mathematical expression 1 is "$X>0$", the mathematical expression 2 is "$Y>0$", the mathematical expression 3 is "$Y=40.1X+1.6$", the mathematical expression 4 is "$Y=-9.0X+5.6$", the mathematical expression 5 is "$Y=-12.1X+6.0$", and the mathematical expression 6 is "$Y=-14.7X+7.1$".

In the above construction, the driven spur includes at least one spur having the teeth, each of which has the front end surface, and the length X of the front end surface of the driven spur and the angle Y of the driven spur are configured to be within the first area, even when the driven spur is inclined so that the recording medium is drawn to the guide surface. The mathematical expressions 3 to 6 are obtained by transporting different types of first to fourth recording mediums under a predetermined environment and evaluating transport results. The mathematical expression 3 is an expression representing a boundary between a range in which no jam occurs in the transported recording medium and a range in which the jam occurs in the transported recording medium. The mathematical expressions 4 to 6 are expressions each representing a boundary between a range in which the liquid is less likely to be transferred to the transported recording medium by the driven spur and a range in which the liquid is transferred to the transported recording medium by the driven spur. Therefore, it is possible to suppress occurrence of both the jam of the recording medium and the dirt on the recording medium at the time of transporting the recording medium.

The recording apparatus of the present teaching is configured such that the driven spur includes at least one spur having the teeth, each of which has the front end surface, and that the length X of the front end surface of the driven spur and the angle Y of the driven spur are within the first area, even when the driven spur is inclined so that the recording medium is drawn to the guide surface. Therefore, it is possible to suppress the occurrence of both the jam of the recording medium and the dirt on the recording medium at the time of transporting the recording medium.

BRIEF DESCRIPTION OF THE DRAWINGS

FIGS. 10A to 10D each show a state of a paper positioning operation by the positioning mechanism, wherein FIG. 10A is a condition diagram showing a condition of when the paper is transported by a driving roller and the driven spur; FIG. 10B is a condition diagram showing a condition of when the paper is transported while being brought in contact with a guide surface; FIG. 10C is an illustrative view showing a distance which causes the tooth to make contact with the paper while the driven spur rotates one revolution; and FIG. 100D is a partial cross-sectional view showing a contact state between the tooth and the paper when the paper is transported while being brought in contact with the guide surface.

DESCRIPTION OF THE EMBODIMENTS

Hereinbelow, an embodiment of the present teaching will be described below while referring to the accompanying drawings.

Figure 1:
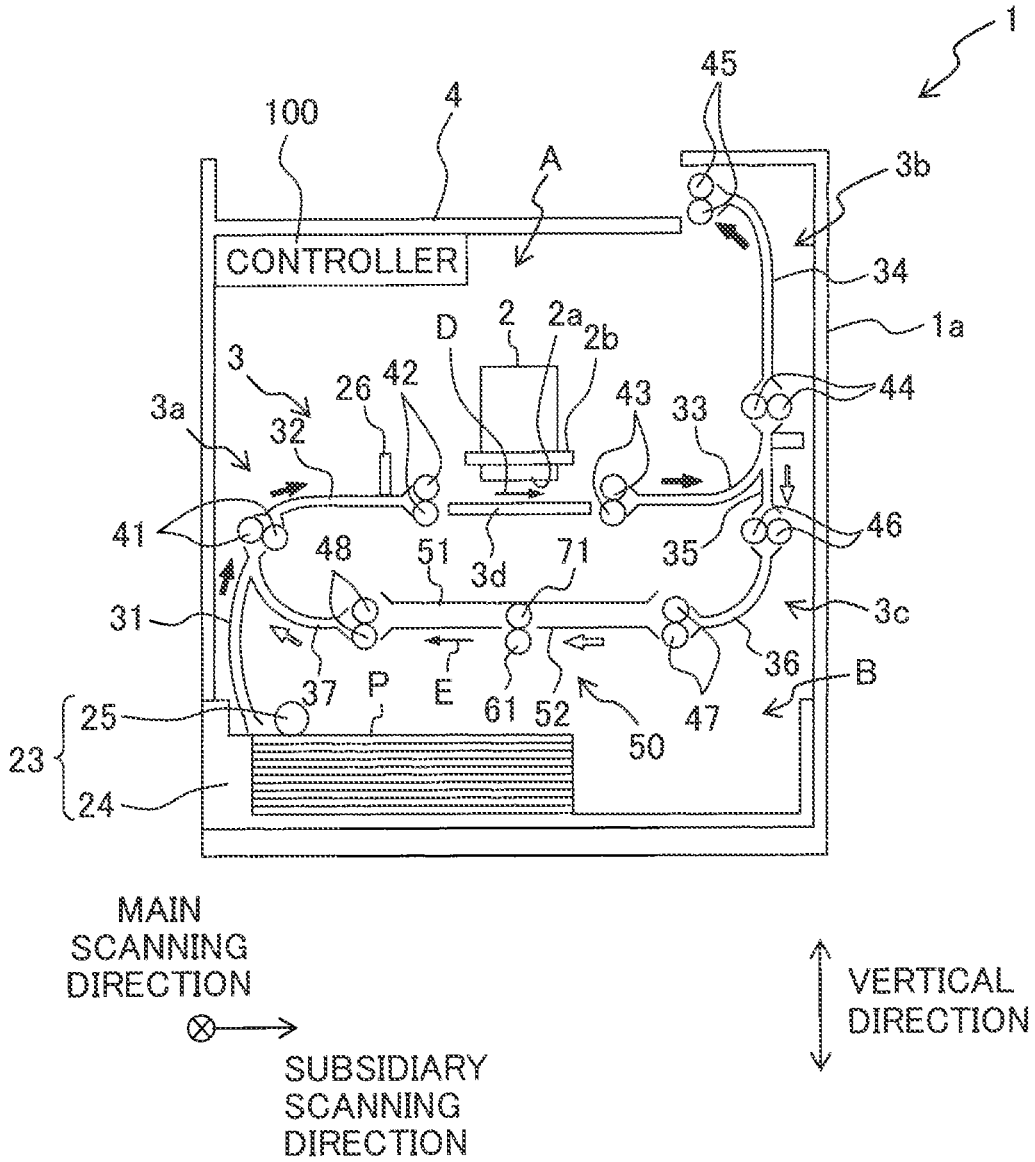
FIG. 1 is a schematic side view illustrating the internal structure of an ink-jet printer which is an embodiment of a recording apparatus according to the present teaching.

At first, an explanation will be made about an overall construction of an ink-jet printer 1 as an embodiment of a recording apparatus according to the present teaching with reference to FIG. 1.

The printer 1 includes a casing 1*a* in a rectangular parallelepiped shape. A paper discharge section 4 is provided at an upper portion of a ceiling plate of the casing 1*a*. The internal space of the casing 1*a* can be divided into spaces A, B in this order from the top. Those formed in the spaces A, B are a paper transport path which is directed from a paper feed section 23 to the paper discharge section 4 and a paper refeed path which is directed from a downstream side to an upstream side of the paper transport path. As shown in FIG. 1, a paper P is transported along black arrows in the paper transport path, and the paper P is transported along white arrows in the paper refeed path. In the space A, image recording on the paper P, transport of the paper P to the paper discharge section 4, and refeeding of the paper P are performed. In the space B, paper feeding from the paper feed section 23 to the paper transport path is performed.

In the space A, a head 2 discharging a black ink, a transport unit 3, a controller 100, and the like are arranged. The head 2 is an example of a recording section of the present teaching. Further, an unillustrated ink cartridge is installed in the space A. The black ink is stored in the cartridge. The cartridge is connected to the head 2 via an unillustrated tube and an unillustrated pump and the ink is supplied to the head 2.

The head 2 is a line-type head having a substantially rectangular parallelepiped shape elongated in a main scanning direction. Many discharge ports are open on the lower surface of the head 2, and thereby defining a discharge surface 2*a*. In a case that recording is performed, the black ink is discharged from the discharge surface 2*a*. The head 2 is supported by the casing 1*a* by the aid of a head holder 2*b*. The head holder 2*b* holds the head 2 so that a predetermined gap, which is suitable for the recording, is formed between the discharge surface 2*a* and a platen 3*d* which will be described later.

The transport unit 3 includes an upstream guide section 3*a*, a downstream guide section 3*b*, a refeed guide section 3*c*, and the platen 3*d*. The platen 3*d* is arranged at a position opposed to the discharge surface 2*a* of the head 2. The platen 3*d* has a flat upper surface. The platen 3*d* supports the paper P from below and constitutes a recording area, which is a part of the paper transport path, between the discharge surface 2*a* and the platen 3*d*. The upstream guide section 3*a* and the downstream guide section 3*b* are arranged with the platen 3*d* intervening therebetween. The upstream guide section 3*a* includes two guides 31, 32 and two transport roller pairs 41, 42. The upstream guide section 3*a* connects the recording area positioned between the platen 3*d* and the head 2 with the paper feed section 23. The downstream guide section 3*b* includes two guides 33, 34 and three transport roller pairs 43 to 45 and connects the recording area with the paper discharge section 4. The paper transport path is defined by the four guides 31 to 34, the platen 3*d*, and the head 2.

The refeed guide section 3*c*, which is an example of a transport mechanism of the present teaching, includes three guides 35 to 37, three transport roller pairs 46 to 48, and a positioning mechanism 50, and the refeed guide section 3*c* connects the upstream guide section 3*a* and the downstream guide section 3*b* while making a detour to avoid the recording area. The guide 35 is connected to an intermediate portion of the guide 33, and the guide 35 connects the refeed guide section 3*c* with the downstream guide section 3*b*. The guide 37 is connected to an intermediate portion of the guide 31, and the guide 37 connects the refeed guide section 3*c* with the upstream guide section 3*a*. The paper refeed path is defined by the three guides 35 to 37 and the positioning mechanism 50.

In the transport roller pair 44, the transport direction of the paper P is switched in accordance with the control of the controller 100. In other words, the transport roller pair 44 rotates so that the paper P is transported upwardly in a case that the paper P is transported from the recording area to the paper discharge section 4. On the other hand, in a case that the paper P is transported from the paper transport path to the paper refeed path, the direction of rotation of the transport roller pair 44 is switched as follows. That is, in a case that the backward end of the paper P is positioned between the transport roller pair 44 and a portion connecting the guide 33 with the guide 35 and that the backward end of the paper P is detected or sensed by a paper sensor 27, the paper P is transported downwardly such that the backward end of the paper P detected by the paper sensor 27 is positioned as the forward end. The paper P, which is transported from the paper transport path to the paper refeed path, is refed to the upstream guide section 3*a*. In this situation, the paper P, which is subjected to the refeeding, is transported again to the recording area in a state that the paper P is turned upside down as compared with when the paper P passed through the recording area just before. Accordingly, it is possible to record images on the both surfaces of the paper P.

The three transport roller pairs 46 to 48 are arranged in this order, and the positioning mechanism 50 is arranged between the transport roller pairs 47, 48. Further, the positioning mechanism 50 is arranged between the recording area and the paper feed section 23 in a vertical direction, that is, between the platen 3*d* and the paper feed section 23. The positioning mechanism 50 includes an upper guide 51, a lower guide 52, a driving roller 61, and a driven spur 71. The positioning mechanism 50 transports the paper P while allowing one end in a width direction of the paper P transported to the space between the both guides 51, 52 to abut against a guide surface 54*a*, and thereby positioning the paper P in the width direction. Details of the positioning mechanism 50 will be described later. The width direction of the paper P is the main scanning direction, which is a direction perpendicular to a transport direction E of the paper P.

The paper feed section 23 is arranged in the space B. The paper feed section 23 includes a paper feed tray 24 and a paper feed roller 25. The paper feed tray 24 is installable/removable with respect to the casing 1*a*. The paper feed tray 24 is a box which is open upwardly, and the paper feed tray 24 can accommodate a plurality of pieces of paper P. The paper feed roller 25 feeds the paper P disposed at the upper most position in the paper feed tray 24.

A subsidiary scanning direction is a direction parallel to a paper transport direction D in which the paper P is transported by the transport roller pairs 42, 43 and the paper transport direction E in which the paper P is transported by the transport roller pairs 47, 48. The main scanning direction is a direction parallel to the horizontal plane and perpendicular to the subsidiary scanning direction.

Next, the controller 100 will be explained. The controller 100 controls the operation of respective components of the printer 1, and the controller 100 manages the operation of the entire printer 1. The controller 100 controls a recording operation on the basis of a recording command supplied from any external apparatus such as a PC connected to the printer 1. Specifically, the controller 100 controls, for example, a transport operation for the paper P and an ink discharge operation in synchronization with the transport of the paper P.

For example, in a case that a recording command to perform the recording on one side of the paper P is received from the external apparatus, the controller 100 drives the paper feed section 23 and the transport roller pairs 41 to 45 based on this recording command. The paper P, which is fed from the paper feed tray 24, is guided by the upstream guide section 3*a*, and the paper P is fed to the recording area, that is, a space between the platen 3*d* and the head 2. When the paper P passes just under the head 2, the head 2 is controlled by the controller 100 and ink droplets are discharged from the head 2. Accordingly, a desired image is recorded on the surface of the paper P. The ink discharge operation such as ink discharge timing is based on a detection signal supplied from a paper sensor 26. The paper sensor 26 is arranged upstream of the head 2 in the transport direction, and the paper sensor 26 detects the forward end of the paper P. The paper P, on which the image has been recorded, is guided by the downstream guide section 3*b*, and the paper P is discharged from the upper portion of the casing 1*a* to the paper discharge section 4.

For example, in a case that a recording command to perform the recording on both sides of the paper P is received from the external apparatus, the controller 100 drives the paper feed section 23 and the transport roller pairs 41 to 45 on the basis of this recording command. At first, an image is formed on the surface of the paper P in the same manner as the single-sided recording, and the paper P is transported toward the paper discharge section 4. As shown in FIG. 1, the paper sensor 27 is arranged, in an intermediate portion of the guide section 3*b*, at a position in the vicinity of the upstream side of the transport roller pair 44. When the paper sensor 27 detects the backward end of the paper P, the transport roller pair 44 is reversely rotated and the transport direction of the paper P is inverted under the control of the controller 100. In this situation, the transport roller pairs 46 to 48 and the driving roller 61 are also driven. Accordingly, the path for transporting the paper P is switched and the paper P is transported along the paper refeed path indicated by the white arrows in FIG. 1. In this situation, the positioning mechanism 50 positions the paper P in the main scanning direction and the positioned paper P is refed to the recording area. The paper P, which is refed from the paper refeed path to the upstream guide section 3*a*, is supplied again to the recording area while being turned upside down, and an image is recorded on the back surface. In a case that the forward end of the paper P is detected by the paper sensor 26 prior to the image recording on the back surface, the transport roller pair 44 is returned to perform the forward rotation. The paper P, which has been subjected to the both sides recording, is discharged to the paper discharge section 4 via the downstream guide section 3*b*.

Figure 2:
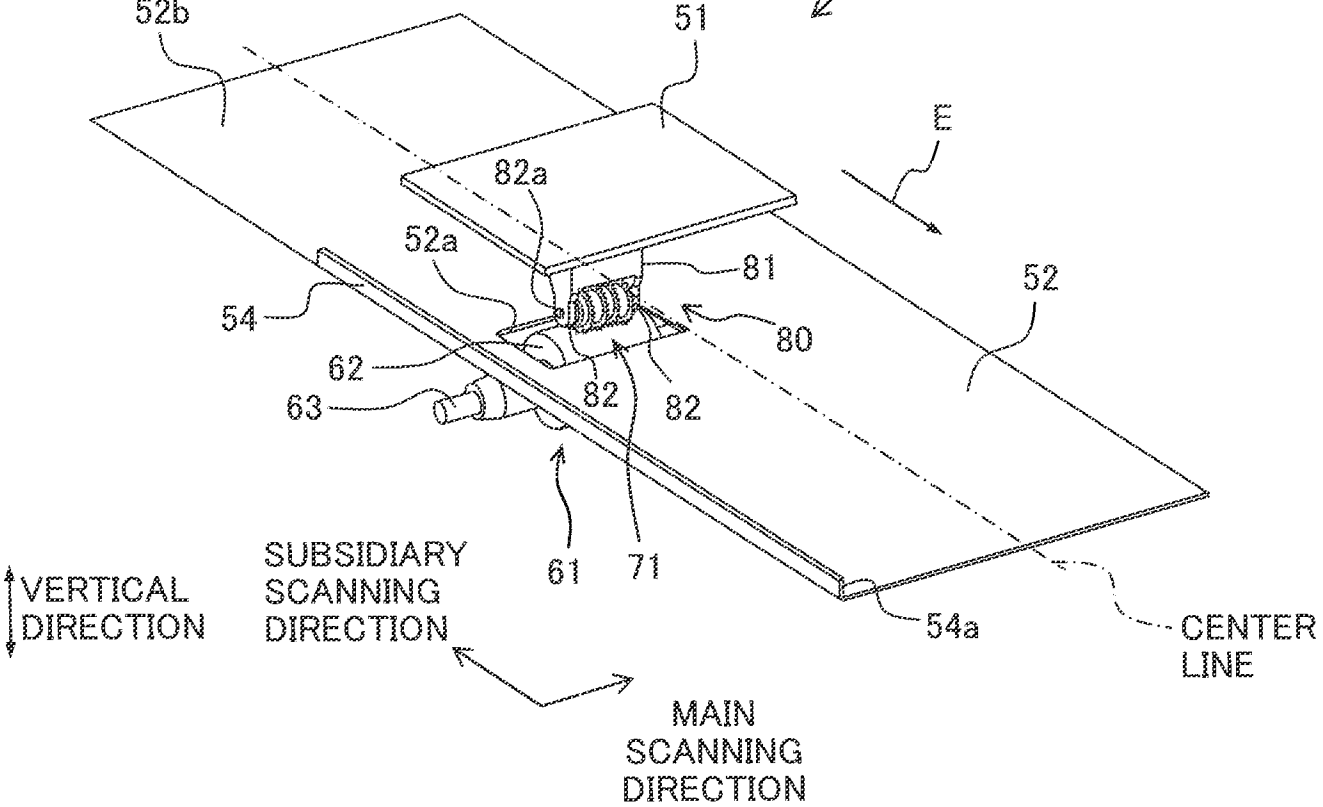
FIG. 2 is a schematic perspective view illustrating a positioning mechanism shown in FIG. 1.
Figure 3:
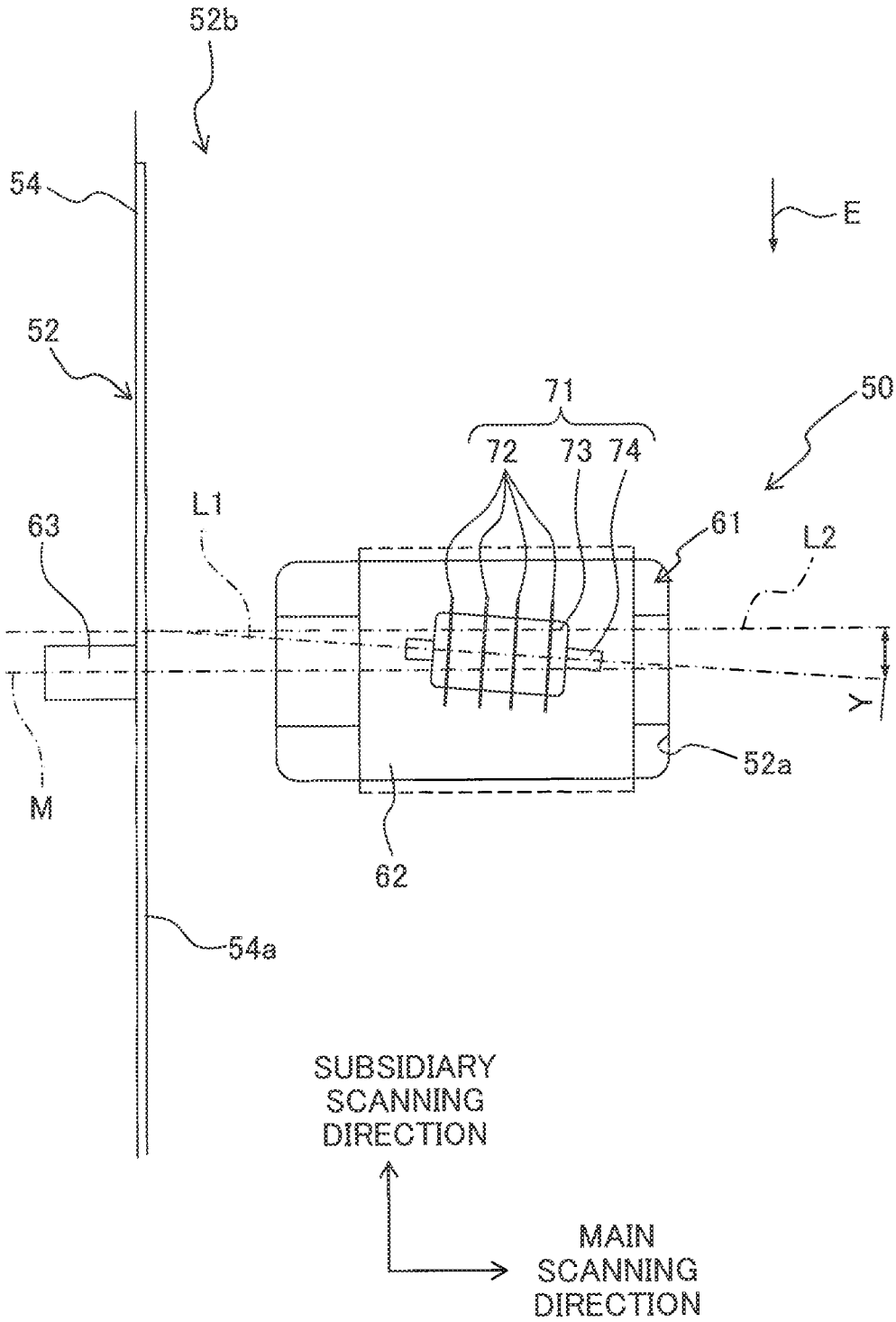
FIG. 3 is a plan view of main components of the positioning mechanism.

Next, the positioning mechanism 50 will be explained in detail with reference to FIGS. 2 to 4. As shown in FIG. 2, both of the upper guide 51 and the lower guide 52 of the positioning mechanism 50 are plate-shaped members which are arranged while being separated from each other in the vertical direction. The space, which is provided between the guides 51 and 52, defines a transport path which is a part of the paper refeed path. The lower guide 52 is formed with a hole 52*a* penetrating in a thickness direction. As shown in FIG. 3, the hole 52*a* has a width in the subsidiary direction slightly smaller than the driving roller 61. The lower guide 52 includes a transport surface 52*b* which supports the lower surface of the transported paper P. A vertical section 54, which is provided upstandingly in the vertical direction, is formed at one end of the lower guide 52 in the main scanning direction. The vertical section 54 extends in the subsidiary scanning direction and includes a guide surface 54*a* which is a vertical surface of which in-plane direction is parallel to the subsidiary scanning direction. The guide surface 54*a* corresponds to one side surface of the vertical section 54 on the side of the driven spur 71. In FIG. 2, only a part of the upper guide 51 is shown.

The driving roller 61 and the driven spur 71 facing the driving roller 61 are arranged at a position closer, in the main scanning direction, to the guide surface 54*a* from the center of the transport path between the upper guide 51 and the lower guide 52. The center of the transport path is depicted by alternate long and short dash lines in FIG. 2. The driven spur 71 rotates by the rotation of the driving roller 61 or in association with the transport of the paper P transported by the driving roller 61.

As shown in FIG. 2, the driving roller 61 includes a columnar roller body 62 and a shaft 63 rotating together with the roller body 62. The roller body 62 is disposed at a position which is opposed to the hole 52*a* and below the driven spur 71. The roller body 62 is arranged so that the upper end thereof slightly protrudes upward from the transport surface 52*b* of the lower guide 52, and the roller body 62 makes contact with the lower surface of the paper P transported on the transport surface 2*b*. In other words, the driving roller 61 is arranged to be contactable with a surface of the paper P on which no image is recorded. The shaft 63 is fixed to the roller body 62 in a state of being inserted through the roller body 62 so as to constitute the rotational shaft of the driving roller 61. The shaft 63 is supported rotatably by the casing 1*a*. The positioning mechanism 50 includes an unillustrated driving mechanism having a driving motor, a gear transmitting rotational force from the driving motor, and the like. The driving mechanism is driven by the control of the controller 100 and rotates the roller body 62 via the shaft 63. As shown in FIG. 3, the driving roller 61 is arranged so that an axis M of the shaft 63 is parallel to the main scanning direction. That is, the driving roller 61 is arranged so that the axis M of the shaft 63 is perpendicular to the guide surface 54*a*.

Further, as shown in FIG. 2, the positioning mechanism 50 includes a support section 80 supporting the driven spur 71. The support section 80 has a support section body 81 and an unillustrated urging section which urges the support section body 81 downwardly. The support section body 81 is attached to the lower surface of the upper guide 51 via the urging section. A pair of flanges 82 protruding downwardly is formed on the lower surface of the support section body 81. Holes 82*a* penetrating in the main scanning direction are formed in the pair of flanges 82. By inserting a shaft 74 of the driven spur 71 in the holes 82*a*, the driven spur 71 is supported rotatably by the support section 80. The urging section is formed of an elastic member such as a coil spring fixed to the upper guide 51, and urges the driven spur 71 downwardly toward the driving roller 61 together with the support section body 81. Accordingly, a predetermined nipping force for nipping the paper P is generated between the driven spur 71 and the driving roller 61. Thus, the paper P is transported in the transport direction E while being interposed or nipped between the driving roller 61 and the driven spur 71. The driven spur 71 is arranged to be contactable with a recorded surface of the paper P on which the image has been recorded.

As shown in FIG. 3, the driven spur 71 includes four spurs 72, a columnar roller body 73, and a shaft 74 rotating together with the roller body 73. The driven spur 71 is arranged at a position overlapping with the guide surface 54*a* in the transport direction E. The shaft 74 is fixed to the roller body 73 in a state of being inserted through the roller body 73 so as to constitute the rotational shaft of the driving roller 71. Further, as shown in FIG. 3, the shaft 74 is arranged so that an angle Y between an axis L1 and an imaginary line L2, which is perpendicular to the guide surface 54*a* passing through a point of intersection between the axis L1 and the guide surface 54*a* and is parallel to the axis M, is 1.2 degrees. In other words, the shaft 74 is arranged so that an angle between the axis L1 and a portion, of the guide surface 54*a*, which is downstream of the point of intersection between the axis L1 and the guide surface 54*a* in the transport direction E, is an acute angle. The angle Y may be positioned in an overlapped area U5K in which four areas U1K, U2K, U3K, and U4K which will be described later are overlapped with each other, and details thereof will be described later. The shaft 74 is disposed so that the axis L1 is perpendicular to the guide surface 54*a* as viewed in the transport direction E.

Figure 4A:
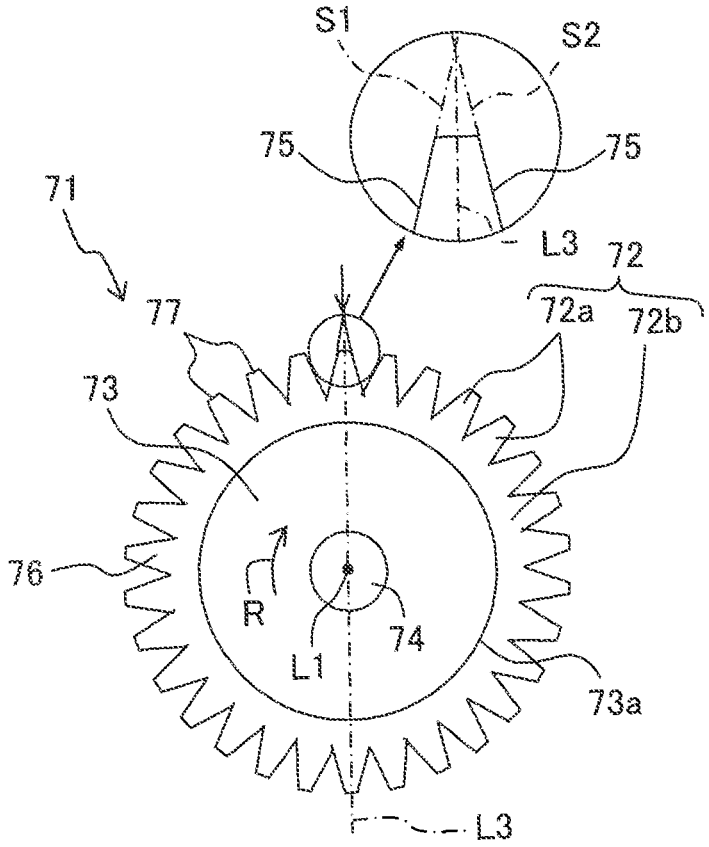
FIG. 4A is a side view of a driven spur and FIG. 4B is an enlarged perspective view of main components of a tooth of a spur.

As shown in FIG. 4A, each of the spurs 72 is a metallic thin-plate member including a plurality of teeth 72*a* and an annular section 72*b* fixed to an outer circumferential surface 73*a* of the roller body 73. Each of the teeth 72*a* protrudes from the annular section 72*b* in a first direction, which is a direction perpendicular to the axis L1, as viewed from the direction of the axis L1, and the teeth 72*a* are arranged and aligned in a circumferential direction R with the axis L1 as a center. The circumferential direction R is a direction indicated by an arrow R in FIG. 4A. Here, the first direction is a direction which passes through the axis L1 and is perpendicular to the axis L. As shown in FIG. 4A, each of the teeth 72*a* includes two side surfaces 75 which are along the direction of the axis L1, two side surfaces 76 which are perpendicular to the direction of the axis L1 and parallel to the first direction, and a front end surface 77 which is connected with the four side surfaces 75, 76. The two side surfaces 75 are inclined to come closer to an imaginary line L3 perpendicular to the axis L1 at positions nearer to the tooth tip than the base or root of each tooth 72*a*. In other words, the two side surfaces 75 are inclined to come closer to the imaginary line L3 perpendicular to the axis L1 at positions nearer to the outside in a radial direction than a connecting portion with the annular section 72*b*. The two side surfaces 76 are arranged parallel to each other. The front end surface 77 is formed at a position closer to the axis L1 than a line of intersection of two imaginary planes S1, S2 extending along the two side surfaces 75. Thus, each tooth 72*a* has the tooth tip which is not so sharp, and the front end of each tooth 72*a* of the driven spur 71 is less likely to stick in the paper P. As a result, each front end surface 77 of the driven spur 71 makes contact with the paper P in a state that each tooth tip does not bite into the paper P so much, and thereby the driven spur 71 is rotated in association with the transport of the paper P.

Figure 4B:
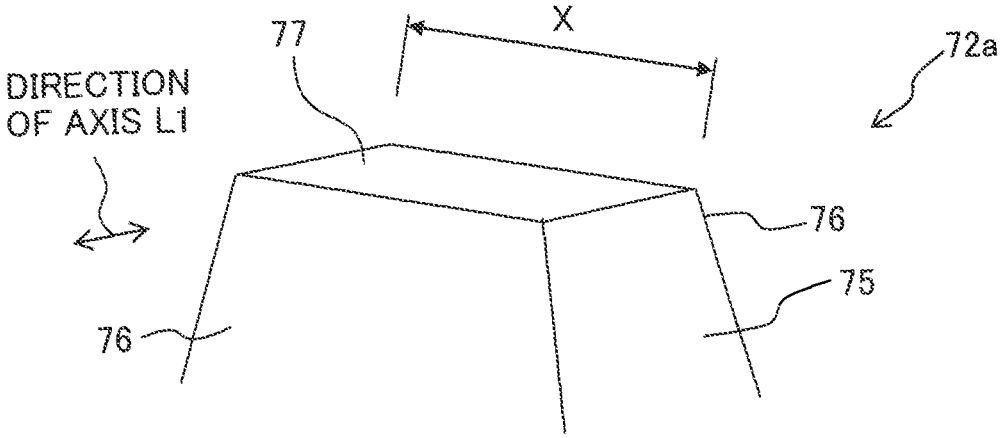

As shown in FIG. 4B, the front end surface 77 is substantially flat. The front end surface 77 has a length X in a second direction, which is an in-plane direction of the front end surface 77 and is perpendicular to the direction of the axis L1, and the length X is 0.07 mm. Here, the second direction is a direction which is perpendicular to both the axis L and the first direction. Similar to the angle Y, the length X may also be positioned in the overlapped area U5K which will be described later, and details thereof will be described later.

The four areas U1K, U2K, U3K, and U4K and the overlapped area U5K in which the four areas U1K, U2K, U3K, and U4K are overlapped with each other will be explained below while referring to FIGS. 5 to 9. At first, the area U1K will be explained. The area U1K is an area which is surrounded by X-axis, Y-axis, and two straight lines K1, K2 shown in FIG. 5 and is surrounded by mathematical expressions 1 to 4 which will be described later in the graph of FIG.

Figure 5:
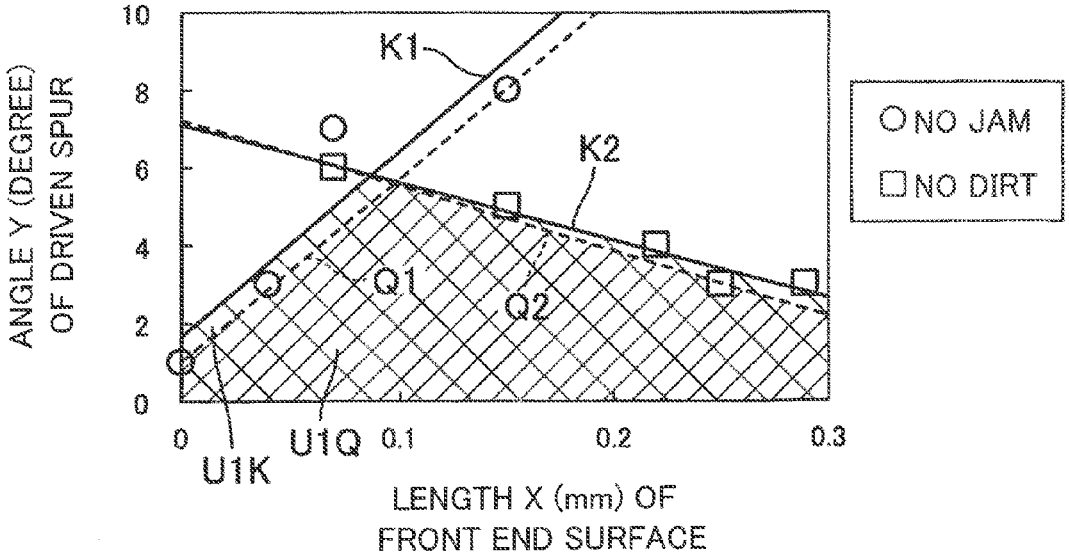
FIG. 5 is a graph showing a relation between a length of a front end surface of the driven spur and an angle of the driven spur regarding presence or absence of occurrence of jam and dirt at the time of transporting a first paper.

5. The area U1K is hatched in FIG. 5. In FIG. 5, the length X (mm) of the front end surface 77 is a horizontal axis and the angle Y (degree) is a vertical axis.

The mathematical expression 1 is "X>0", the mathematical expression 2 is "Y>0", the mathematical expression 3 is "Y=47.5X+1.7", and the mathematical expression 4 is "Y=−14.7X+7.1".

TABLE 1 given below shows presence or absence of occurrence of jam and dirt in a first paper (BP60PA, produced by Brother Industries, Ltd.) in a case that an image having a predetermined pattern is recorded on the first paper and the first paper is refed to the positioning mechanism 50 under various conditions of the length X of the front end surface 77 of each tooth 72*a* of the driven spur 71 and the angle Y of the driven spur 71. Noted that the length X of the front end surface 77 is changed by removing the tip of each tooth of a spur, which has a diameter of 6 mm and teeth each having the sharp tooth tip, at positions directed toward the center of the spur from the tip of each tooth. That is, in a case that the tip of each tooth is removed at a position located 0 mm from the tip of each tooth, the length X of the front end surface 77 is 0 mm; that the tip of each tooth is removed at a position located 0.05 mm from the tip of each tooth, the length X of the front end surface 77 is 0.04 mm; that the tip of each tooth is removed at a position located 0.1 mm from the tip of each tooth, the length X of the front end surface 77 is 0.07 mm; that the tip of each tooth is removed at a position located 0.2 mm from the tip of each tooth, the length X of the front end surface 77 is 0.15 mm; that the tip of each tooth is removed at a position located 0.3 mm from the tip of each tooth, the length X of the front end surface 77 is 0.22 mm; that the tip of each tooth is removed at a position located 0.35 mm from the tip of each tooth, the length X of the front end surface 77 is 0.25 mm; and that the tip of each tooth is removed at a position located 0.4 mm from the tip of each tooth, the length X of the front end surface 77 is 0.29 mm. By adopting these spurs sequentially, the length X of the front end surface 77 of the driven spur 71 is changed. Further, results shown in TABLE 1 were obtained under the following conditions: each spur 72 has 30 teeth; the quality of material of each spur 72 is SUS304-CSP (stainless steel for spring); the roller body 62 of the driving roller 61 has the diameter of 13.4 mm; the material of the roller body 62 of the driving roller 61 is ethylene-propylene-diene rubber (EPDM); the nipping force between the driving roller 61 and the driven spur 71 is 1N; and evaluation environments are that the temperature is 21 degrees Celsius and the humidity is 37%.

As shown in TABLE 1, in a case that the length X of the front end surface (hereinafter simply referred to as "length X") is 0 mm and the angle Y is 1 degrees, that the length X is 0.04 mm and the angle Y is 3 degrees, that the length X is 0.07 mm and the angle Y is 7 degrees, and that the length X is 0.15 mm and the angle Y is 8 degrees, no jam occurs in each of the cases and the result in each of the cases is evaluated as "Jam OK" (hereinafter referred to as "No jam" and shown as "No jam" in TABLE 1). That is, "No jam" indicates that the jam of the paper P did not occur. Noted that, in a case that the length X is 0.04 mm and the angle Y is an angle of not more than 3 degrees, that the length X is 0.07 mm and the angle Y is an angle of not more than 7 degrees, and that the length X is 0.15 mm and the angle Y is an angle of not more than 8 degrees, each of the results is presumed as "No jam". Here, in a case that the length X is 0.07 mm and the angle Y is 6 degrees, that the length X is 0.15 mm and the angle Y is 5 degrees, and that the length X is 0.15 mm and the angle Y is 6 degrees, only the result for evaluation of the dirt is shown in each of the cases. Since the evaluation of the dirt can be performed in a case of "No jam", in the case that the length X is 0.07 mm and the angle Y is 6 degrees, that the length X is 0.15 mm and the angle Y is 5 degrees, and that the length X is 0.15 mm and the angle Y is 6 degrees, each of the cases is also evaluated as "No jam". Meanwhile, in a case that the length X is 0 mm and the angle Y is 2 degrees, that the length X is 0.04 mm and the angle Y is 4 degrees, that the length X is 0.07 mm and the angle Y is 8 degrees, and that the length X is 0.15 mm and the angle Y is 9 degrees, the jam occurred in each of the cases and the result in each of the cases is evaluated as "Jam NG" (hereinafter referred to as "Jam occurred" and shown as "Jam occurred" in TABLE 1). That is, "Jam occurred" indicates that the jam of the paper P occurred. Noted that, in a case that the length X is 0 mm and the angle Y is an angle of not less than 2 degrees, that the length X is 0.04 mm and the angle Y is an angle of not less than 4 degrees, that the length X is 0.07 mm and the angle Y is an angle of not less than 8 degrees, and that the length X is 0.15 mm and the angle Y is an angle of not less than 9 degrees, each of the results is presumed as "Jam occurred". The straight line K1 shown in FIG. 5 is an approximate straight line of four coordinates in cases of being evaluated as "No jam" in TABLE 1, and an approximate expression of the straight line K1 as the mathematical expression 3 is calculated from these coordinates. Thus, the mathematical expression 3 is an expression representing a boundary of the presence or absence of occurrence of the jam in the transported first paper.

TABLE 1

| | | Length X (mm) of front end surface | | | | | | |
|---|---|---|---|---|---|---|---|---|
| | | 0 | 0.04 | 0.07 | 0.15 | 0.22 | 0.25 | 0.29 |
| Angle Y (degree) of driven spur | 1 | No jam | | | | | | |
| | 2 | Jam occurred | | | | | | |
| | 3 | | No jam | | | | No dirt | No dirt |
| | 4 | | Jam occurred | | | No dirt | Some dirt | Some dirt |
| | 5 | | | | No dirt | Some dirt | | |
| | 6 | | | No dirt | Some dirt | | | |
| | 7 | | | Some dirt | | | | |
| | 8 | | | No jam Jam occurred | No jam | | | |
| | 9 | | | | Jam occurred | | | |

Further, as shown in TABLE 1, in a case that the length X is 0.07 mm and the angle Y is 6 degrees, that the length X is 0.15 mm and the angle Y is 5 degrees, that the length X is 0.22 mm and the angle Y is 4 degrees, that the length X is 0.25 mm and the angle Y is 3 degrees, and that that the length X is 0.29 mm and the angle Y is 3 degrees, the first paper is not dirty in each of the cases and the result in each of the cases is evaluated as "Dirt OK" (hereinafter referred to as "No dirt" and shown as "No dirt" in TABLE 1). Noted that in the case that the length X is 0 mm and the angle Y is 1 degrees and that the length X is 0.04 mm and the angle Y is 3 degrees, each of the cases is evaluated as "No dirt". In the case that the length X is 0 mm and the angle Y is 2 degrees and that the length X is 0.04 mm and the angle Y is 4 degrees, the jam occurred in each of the cases and the evaluation of the dirt can not be performed in each of the cases. In a case that the length X is 0.07 mm and the angle Y is an angle of not more than 6 degrees, that the length X is 0.15 mm and the angle Y is an angle of not more than 5 degrees, that the length X is 0.22 mm and the angle Y is an angle of not more than 4 degrees, that the length X is 0.25 mm and the angle Y is an angle of not more than 3 degrees, and that that the length X is 0.29 mm and the angle Y is an angle of not more than 3 degrees, each of the results is presumed as "No dirt". An evaluation method of the dirt is as follows. That is, in a case that a human being having 20/20 vision looks at a discharged paper in a state that the discharge paper is kept away from the human being by 70 cm in a bright room with illuminance 534 lux and that the dirt such as an ink mark transferred to the paper P from each tooth 72*a* is invisible, it is evaluated as "No dirt". On the other hand, in a case that the dirt is visible, it is evaluated as "Dirt NG" (hereinafter referred to as "Some dirt" and shown as "Some dirt" in TABLE 1). In other words, "No dirt" means that there is no dirt on the paper P and "Some dirt" means that there is the dirt on the paper P. Meanwhile, in a case that the length X is 0.07 mm and the angle Y is 7 degrees, that the length X is 0.15 mm and the angle Y is 6 degrees, that the length X is 0.22 mm and the angle Y is 5 degrees, that the length X is 0.25 mm and the angle Y is 4 degrees, and that the length X is 0.29 mm and the angle Y is 4 degrees, there is the dirt on the first paper in each of the cases and each of the results is evaluated as "Some dirt". Noted that in a case that the length X is 0.07 mm and the angle Y is an angle of not less than 7 degrees, that the length X is 0.15 mm and the angle Y is an angle of not less than 6 degrees, that the length X is 0.22 mm and the angle Y is an angle of not less than 5 degrees, that the length X is 0.25 mm and the angle Y is an angle of not less than 4 degrees, and that the length X is 0.29 mm and the angle Y is an angle of not less than 4 degrees, each of the results is presumed as "Some dirt". The straight line K2 shown in FIG. 5 is an approximate straight line of five coordinates in cases of being evaluated as "No dirt" in TABLE 1, and an approximate expression of the straight line K2 as the mathematical expression 4 is calculated from these coordinates. Thus, the mathematical expression 4 is an expression representing a boundary of the presence or absence of occurrence of the dirt in the transported first paper. In the graph of FIG. 5, the mathematical expressions 1 and 2 indicate lower limits of the length X of the front end surface 77 and the angle Y of the driven spur 71.

The area U1K surrounded by the mathematical expressions 1 to 4 is an area in which the occurrence of jam and dirt is suppressed at the time of transporting the first paper. Therefore, by setting the length X of the front end surface 77 of the driven spur 71 and the angle Y of the driven spur 71 within this area, it is possible to suppress the occurrence of both the jam and the dirt.

Next, the area U2K will be explained. The area U2K is an area which is surrounded by X-axis, Y-axis, and two straight lines K3, K4 shown in FIG. 6 and is surrounded by the mathematical expression 2 and mathematical expressions 5 to 7 given below in the graph of FIG. 6. Similar to FIG. 5, the length X (mm) of the front end surface 77 is the horizontal axis and the angle Y (degree) is the vertical axis in FIG. 6.

The mathematical expression 5 is "0.5>X>0", the mathematical expression 6 is "Y=40.1X+2.6", and the mathematical expression 7 is "Y=−6.0X+7.1".

TABLE 2 given below shows presence or absence of occurrence of jam and dirt in a second paper (Business 4200 Paper, 92 bright, 28 lb. bond, 8.5×11, produced by Xerox Corporation. (USA)) in a case that an image having a predetermined pattern is recorded on the second paper and the second paper is refed to the positioning mechanism 50, under various conditions of the length X of the front end surface 77 of each tooth 72*a* of the driven spur 71 and the angle Y of the driven spur 71. TABLE 2 shows results which have been obtained under the same conditions as those of TABLE 1, the conditions including the length X of the front end surface 77, the number of teeth of each spur 72, the quality of material of each spur 72, the diameter of the roller body 62 of the driving roller 61, the quality of material of the roller body 62 of the driving roller 61, the nipping force between the driving roller 61 and the driven spur 71, and the evaluation environments.

TABLE 2

| | | Length X (mm) of front end surface | | | | | | |
|---|---|---|---|---|---|---|---|---|
| | | 0 | 0.04 | 0.07 | 0.15 | 0.22 | 0.25 | 0.29 |
| Angle Y (degree) of driven spur | 1 | | | | | | | |
| | 2 | No jam | | | | | | |
| | 3 | Jam occurred | | | | | | |
| | 4 | | No jam | | | | | |
| | 5 | | Jam occurred | | | | | No dirt |
| | 6 | | | | No dirt | No dirt | No dirt | Some dirt |
| | 7 | | | No jam | Some dirt | Some dirt | Some dirt | |
| | 8 | | | Jam occurred | No jam | | | |
| | 9 | | | | Jam occurred | | | |

Figure 6:
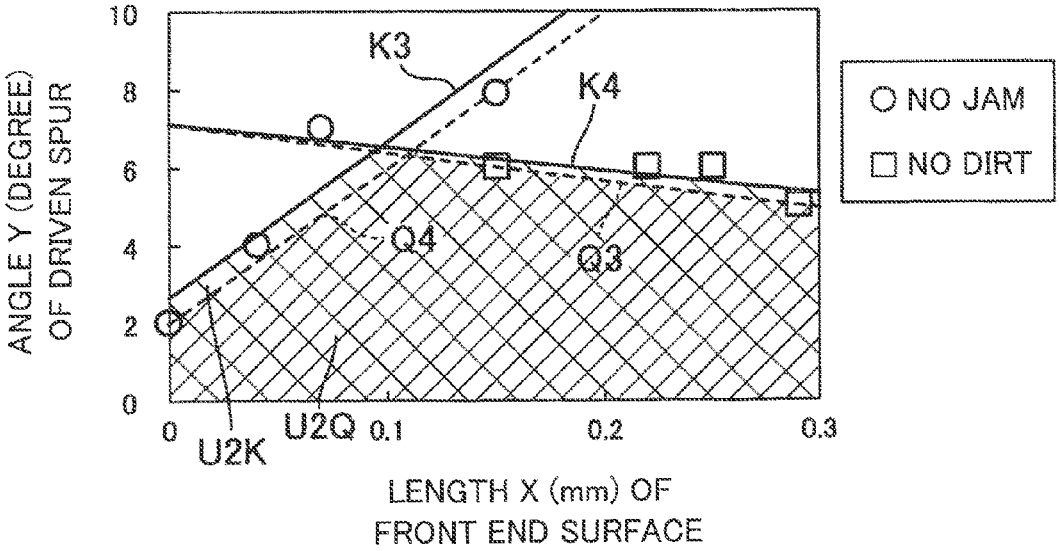
FIG. 6 is a graph showing a relation between the length of the front end surface of the driven spur and the angle of the driven spur regarding presence or absence of occurrence of jam and dirt at the time of transporting a second paper.

As shown in TABLE 2, in a case that the length X of the front end surface (hereinafter simply referred to as "length X") is 0 mm and the angle Y is 2 degrees, that the length X is 0.04 mm and the angle Y is 4 degrees, that the length X is 0.07 mm and the angle Y is 7 degrees, and that the length X is 0.15 mm and the angle Y is 8 degrees, no jam occurs in each of the cases and each of the results is evaluated as "No jam". Noted that, in a case that the length X is 0 mm and the angle Y is an angle of not more than 2 degrees, that the length X is 0.04 mm and the angle Y is an angle of not more than 4 degrees, that the length X is 0.07 mm and the angle Y is an angle of not more than 7 degrees, and that the length X is 0.15 mm and the angle Y is an angle of not more than 8 degrees, each of the results is presumed as "No jam". Meanwhile, in a case that the length X is 0 mm and the angle Y is 3 degrees, that the length X is 0.04 mm and the angle Y is 5 degrees, that the length X is 0.07 mm and the angle Y is 8 degrees, and that the length X is 0.15 mm and the angle Y is 9 degrees, the jam occurred in each of the cases and each of the results is evaluated as "Jam occurred". Noted that, in a case that the length X is 0 mm and the angle Y is an angle of not less than 3 degrees, that the length X is 0.04 mm and the angle Y is an angle of not less than 5 degrees, that the length X is 0.07 mm and the angle Y is an angle of not less than 8 degrees, and that the length X is 0.15 mm and the angle Y is an angle of not less than 9 degrees, each of the results is presumed as "Jam occurred". The straight line K3 shown in FIG. 6 is an approximate straight line of four coordinates in cases of being evaluated as "No jam" in TABLE 2, and an approximate expression of the straight line K3 as the mathematical expression 6 is calculated from these coordinates. Thus, the mathematical expression 6 is an expression representing a boundary of the presence or absence of occurrence of the jam in the transported second paper.

As shown in TABLE 2, in a case that the length X is 0.15 mm and the angle Y is 6 degrees, that the length X is 0.22 mm and the angle Y is 6 degrees, that the length X is 0.25 mm and the angle Y is 6 degrees, and that the length X is 0.29 mm and the angle Y is 5 degrees, the second paper is not dirty in each of the cases and each of the cases is evaluated as "No dirt". An evaluation method of the dirt for TABLE 2 is the same method as TABLE 1. Noted that in the case that the length X is 0 mm and the angle Y is 2 degrees and that the length X is 0.04 mm and the angle Y is 4 degrees, each of the cases is evaluated as "No dirt". In the case that the length X is 0 mm and the angle Y is 3 degrees and that the length X is 0.04 mm and the angle Y is 5 degrees, the jam occurred in each of the cases and the evaluation of the dirt can not be performed in each of the cases. In a case that the length X is 0.15 mm and the angle Y is an angle of not more than 6 degrees, that the length X is 0.22 mm and the angle Y is an angle of not more than 6 degrees, that the length X is 0.25 mm and the angle Y is an angle of not more than 6 degrees, and that the length X is 0.29 mm and the angle Y is an angle of not more than 5 degrees, each of the results is presumed as "No dirt". Meanwhile, in a case that the length X is 0.15 mm and the angle Y is 7 degrees, that the length X is 0.22 mm and the angle Y is 7 degrees, that the length X is 0.25 mm and the angle Y is 7 degrees, and that the length X is 0.29 mm and the angle Y is 6 degrees, there is the dirt on the second paper in each of the cases and each of the results is evaluated as "Some dirt". Noted that in a case that the length X is 0.15 mm and the angle Y is an angle of not less than 7 degrees, that the length X is 0.22 mm and the angle Y is an angle of not less than 7 degrees, that the length X is 0.25 mm and the angle Y is an angle of not less than 7 degrees, and that the length X is 0.29 mm and the angle Y is an angle of not less than 6 degrees, each of the results is presumed as "Some dirt". The straight line K4 shown in FIG. 6 is an approximate straight line of four coordinates in cases of being evaluated as "No dirt" in TABLE 2, and an approximate expression of the straight line K4 as the mathematical expression 7 is calculated from these coordinates. Thus, the expression 7 is an expression representing a boundary of the presence or absence of occurrence of the dirt in the transported second paper. In the graph of FIG. 6, the mathematical expressions 2 and 5 indicate lower limits of the length X of the front end surface 77 and the angle Y of the driven spur 71.

The area U2K surrounded by the mathematical expressions 2, and 5 to 7 is an area in which the occurrence of jam and dirt is suppressed at the time of transporting the second paper. Therefore, by setting the length X of the front end surface 77 of the driven spur 71 and the angle Y of the driven spur 71 within this area, it is possible to suppress the occurrence of both the jam and the dirt.

Next, the area U3K will be explained. The area U3K is an area which is surrounded by X-axis, Y-axis, and two straight lines K5, K6 shown in FIG. 7 and is surrounded by the mathematical expressions 1, 2 and mathematical expressions 8, 9 given below in the graph of FIG. 7. Similar to FIG. 5, the length X (mm) of the front end surface 77 is the horizontal axis and the angle Y (degree) is the vertical axis in FIG. 7.

The mathematical expression 8 is "Y=40.1X+1.6", and the mathematical expression 9 is "Y=−12.1X+6.0".

TABLE 3 given below shows presence or absence of occurrence of jam and dirt in a third paper (Business 4200 Paper, 92 bright, 20 lb. bond, 8.5×11, produced by Xerox Corporation. (USA)) in a case that an image having a predetermined pattern is recorded on the third paper and the third paper is refed to the positioning mechanism 50, under various conditions of the length X of the front end surface 77 of each tooth 72*a* of the driven spur 71 and the angle Y of the driven spur 71. TABLE 3 shows results which have been obtained under the same conditions as those of TABLE 1, the conditions including the length X of the front end surface 77, the number of teeth of each spur 72, the quality of material of each spur 72, the diameter of the roller body 62 of the driving roller 61, the quality of material of the roller body 62 of the driving roller 61, the nipping force between the driving roller 61 and the driven spur 71, and the evaluation environments.

TABLE 3

| | | Length X (mm) of front end surface | | | | | | |
|---|---|---|---|---|---|---|---|---|
| | | 0 | 0.04 | 0.07 | 0.15 | 0.22 | 0.25 | 0.29 |
| Angle Y (degree) of driven spur | 1 | No jam | | | | | | |
| | 2 | Jam occurred | | | | | | No dirt |
| | 3 | | No jam | | | | No dirt | Some dirt |
| | 4 | | Jam occurred | | No dirt | No dirt | Some dirt | |

TABLE 3-continued

| | Length X (mm) of front end surface | | | | | | |
|---|---|---|---|---|---|---|---|
| | 0 | 0.04 | 0.07 | 0.15 | 0.22 | 0.25 | 0.29 |
| 5 | | | No dirt | Some dirt | Some dirt | | |
| 6 | | | No jam Some dirt | | | | |
| 7 | | | Jam occurred | No jam | | | |
| 8 | | | | Jam occurred | | | |
| 9 | | | | | | | |

Figure 7:
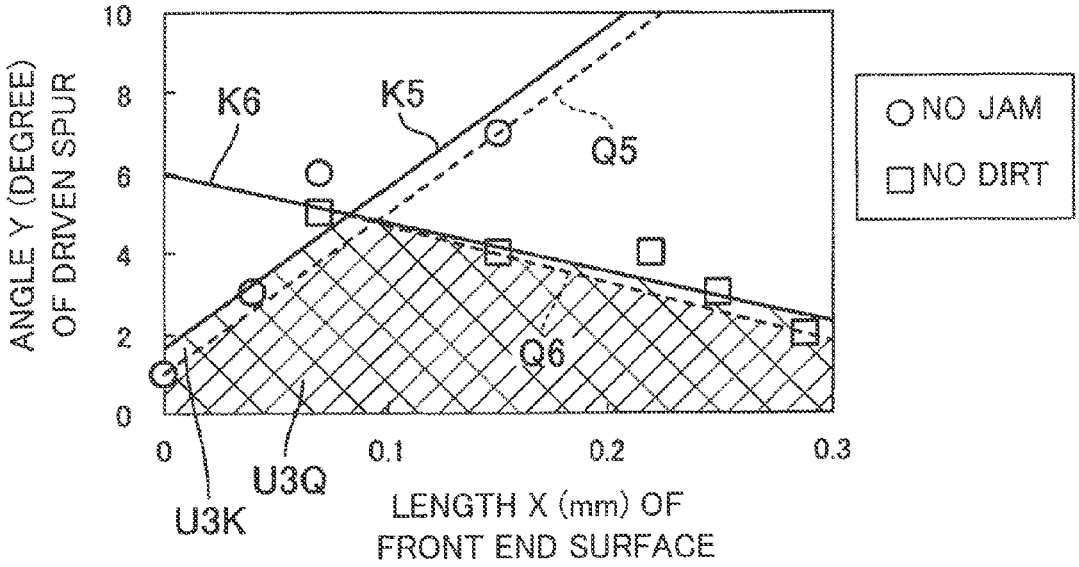
FIG. 7 is a graph showing a relation between the length of the front end surface of the driven spur and the angle of the driven spur regarding presence or absence of occurrence of jam and dirt at the time of transporting a third paper.

As shown in TABLE 3, in a case that the length X of the front end surface (hereinafter simply referred to as "length X") is 0 mm and the angle Y is 1 degrees, that the length X is 0.04 mm and the angle Y is 3 degrees, that the length X is 0.07 mm and the angle Y is 6 degrees, and that the length X is 0.15 mm and the angle Y is 7 degrees, no jam occurs in each of the cases and each of the results is evaluated as "No jam". Noted that, in a case that the length X is 0.04 mm and the angle Y is an angle of not more than 3 degrees, that the length X is 0.07 mm and the angle Y is an angle of not more than 6 degrees, and that the length X is 0.15 mm and the angle Y is an angle of not more than 7 degrees, each of the results is presumed as "No jam". Meanwhile, in a case that the length X is 0 mm and the angle Y is 2 degrees, that the length X is 0.04 mm and the angle Y is 4 degrees, that the length X is 0.07 mm and the angle Y is 7 degrees, and that the length X is 0.15 mm and the angle Y is 8 degrees, the jam occurred in each of the cases and each of the results is evaluated as "Jam occurred". Noted that in a case that the length X is 0 mm and the angle Y is an angle of not less than 2 degrees, that the length X is 0.04 mm and the angle Y is an angle of not less than 4 degrees, that the length X is 0.07 mm and the angle Y is an angle of not less than 7 degrees, and that the length X is 0.15 mm and the angle Y is an angle of not less than 8 degrees, each of the results is presumed as "Jam occurred". The straight line K5 shown in FIG. 7 is an approximate straight line of four coordinates in cases of being evaluated as "No jam" in TABLE 3, and an approximate expression of the straight line K5 as the mathematical expression 8 is calculated from these coordinates. Thus, the mathematical expression 8 is an expression representing a boundary of the presence or absence of occurrence of the jam in the transported third paper.

As shown in TABLE 3, in a case that the length X is 0.07 mm and the angle Y is 5 degrees, that the length X is 0.15 mm and the angle Y is 4 degrees, that the length X is 0.22 mm and the angle Y is 4 degrees, that the length X is 0.25 mm and the angle Y is 3 degrees, and that the length X is 0.29 mm and the angle Y is 2 degrees, the third paper is not dirty in each of the cases and each of the cases is evaluated as "No dirt". Noted that in the case that the length X is 0 mm and the angle Y is 1 degrees and that the length X is 0.04 mm and the angle Y is 3 degrees, each of the cases is evaluated as "No dirt". In the case that the length X is 0 mm and the angle Y is 2 degrees and that the length X is 0.04 mm and the angle Y is 4 degrees, the jam occurred in each of the cases and the evaluation of the dirt can not be performed in each of the cases. In a case that the length X is 0.07 mm and the angle Y is an angle of not more than 5 degrees, that the length X is 0.15 mm and the angle Y is an angle of not more than 4 degrees, that the length X is 0.22 mm and the angle Y is an angle of not more than 4 degrees, that the length X is 0.25 mm and the angle Y is an angle of not more than 3 degrees, and that the length X is 0.29 mm and the angle Y is an angle of not more than 2 degrees, each of the results is presumed as "No dirt". An evaluation method of the dirt for TABLE 3 is the same method as TABLE 1. On the other hand, in a case that the length X is 0.07 mm and the angle Y is 6 degrees, that the length X is 0.15 mm and the angle Y is 5 degrees, that the length X is 0.22 mm and the angle Y is 5 degrees, that the length X is 0.25 mm and the angle Y is 4 degrees, and that the length X is 0.29 mm and the angle Y is 3 degrees, there is the dirt on the third paper in each of the cases and each of the results is presumed as "Some dirt". In a case that the length X is 0.07 mm and the angle Y is an angle of not less than 6 degrees, that the length X is 0.15 mm and the angle Y is an angle of not less than 5 degrees, that the length X is 0.22 mm and the angle Y is an angle of not less than 5 degrees, that the length X is 0.25 mm and the angle Y is an angle of not less than 4 degrees, and that the length X is 0.29 mm and the angle Y is an angle of not less than 3 degrees, each of the results is presumed as "Some dirt". The straight line K6 shown in FIG. 7 is an approximate straight line of five coordinates in cases of being evaluated as "No dirt" in TABLE 3, and an approximate expression of the straight line K6 as the mathematical expression 9 is calculated from these coordinates. Thus, the mathematical expression 9 is an expression representing a boundary of the presence or absence of occurrence of the dirt in the transported third paper. In the graph of FIG. 7, the mathematical expressions 1 and 2 indicate lower limits of the length X of the front end surface 77 and the angle Y of the driven spur 71.

The area U3K surrounded by the mathematical expressions 1, 2 and the mathematical expressions 8, 9 is an area in which the occurrence of jam and dirt is suppressed at the time of transporting the third paper. Therefore, by setting the length X of the front end surface 77 of the driven spur 71 and the angle Y of the driven spur 71 within this area, it is possible to suppress the occurrence of both the jam and the dirt.

Next, the area U4K will be explained. The area U4K is an area which is surrounded by X-axis, Y-axis, and two straight lines K7, K8 shown in FIG. 8 and is surrounded by the mathematical expressions 2, 5 and mathematical expressions 10, 11 given below in the graph of FIG. 8. Similar to FIG. 5, the length X (mm) of the front end surface 77 is the horizontal axis and the angle Y (degree) is the vertical axis in FIG. 8.

The mathematical expression 10 is "Y=34.7X+2.2", and the mathematical expression 11 is "Y=−9.0X+5.6".

TABLE 4 given below shows presence or absence of occurrence of jam and dirt in a fourth paper (Business, Laser, copier and inkjet, A4, 80 g/m$^2$, produced by Xerox Corporation. (USA)) in a case that an image having a predetermined pattern is recorded on the fourth paper and the fourth paper is refed to the positioning mechanism 50, under various conditions of the length X of the front end surface 77 of each tooth 72*a* of the driven spur 71 and the angle Y of the driven spur 71. TABLE 4 shows results which have been obtained under the same conditions as those of TABLE 1, the conditions including the length X of the front end surface 77, the number of teeth of each spur 72, the quality of material of each spur 72, the diameter of the roller body 62 of the driving roller 61, the quality of material of the roller body 62 of the driving roller 61, the nipping force between the driving roller 61 and the driven spur 71, and the evaluation environments.

TABLE 4

| | | Length X (mm) of front end surface | | | | | | |
|---|---|---|---|---|---|---|---|---|
| | | 0 | 0.04 | 0.07 | 0.15 | 0.22 | 0.25 | 0.29 |
| Angle Y (degree) of driven spur | 1 | | | | | | | |
| | 2 | No jam | | | | | | |
| | 3 | Jam occurred | No jam | | | | No dirt | No dirt |
| | 4 | | Jam occurred | | No dirt | No dirt | Some dirt | Some dirt |
| | 5 | | | No dirt | Some dirt | Some dirt | | |
| | 6 | | | No jam Some dirt | | | | |
| | 7 | | | Jam occurred | No jam | | | |
| | 8 | | | | Jam occurred | | | |
| | 9 | | | | | | | |

Figure 8:
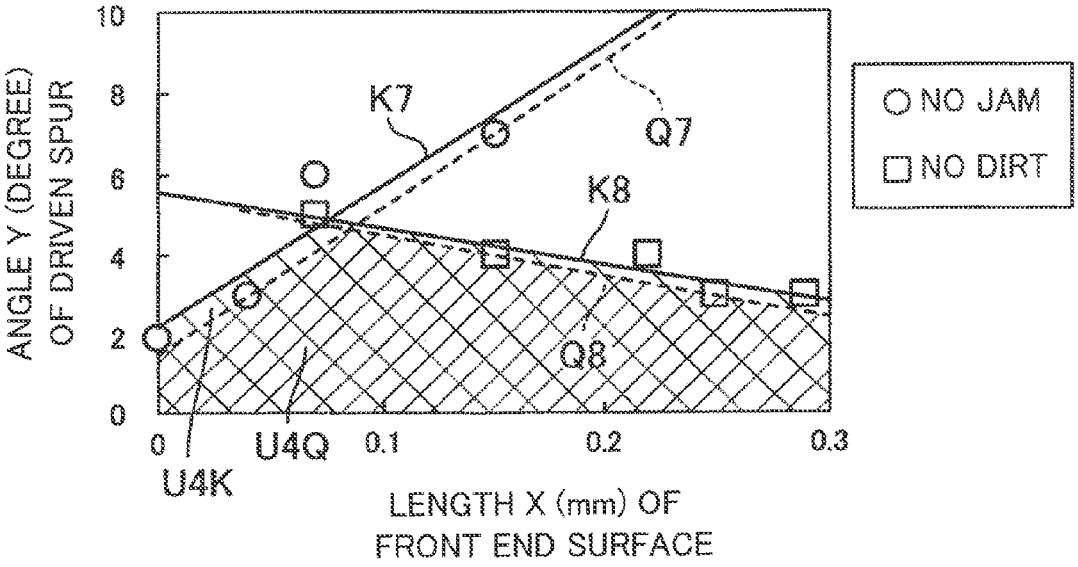
FIG. 8 is a graph showing a relation between the length of the front end surface of the driven spur and the angle of the driven spur regarding presence or absence of occurrence of jam and dirt at the time of transporting a fourth paper.

As shown in TABLE 4, in a case that the length X of the front end surface (hereinafter simply referred to as "length X") is 0 mm and the angle Y is 2 degrees, that the length X is 0.04 mm and the angle Y is 3 degrees, that the length X is 0.07 mm and the angle Y is 6 degrees, and that the length X is 0.15 mm and the angle Y is 7 degrees, no jam occurs in each of the cases and each of the results is evaluated as "No jam". Noted that, in a case that the length X is 0 mm and the angle Y is an angle of not more than 2 degrees, that the length X is 0.04 mm and the angle Y is an angle of not more than 3 degrees, that the length X is 0.07 mm and the angle Y is an angle of not more than 6 degrees, and that the length X is 0.15 mm and the angle Y is an angle of not more than 7 degrees, each of the results is presumed as "No jam". Meanwhile, in a case that the length X is 0 mm and the angle Y is 3 degrees, that the length X is 0.04 mm and the angle Y is 4 degrees, that the length X is 0.07 mm and the angle Y is 7 degrees, and that the length X is 0.15 mm and the angle Y is 8 degrees, the jam occurred in each of the cases and each of the results is evaluated as "Jam occurred". Noted that, in a case that the length X is 0 mm and the angle Y is an angle of not less than 3 degrees, that the length X is 0.04 mm and the angle Y is an angle of not less than 4 degrees, that the length X is 0.07 mm and the angle Y is an angle of not less than 7 degrees, and that the length X is 0.15 mm and the angle Y is an angle of not less than 8 degrees, each of the results is presumed as "Jam occurred". The straight line K7 shown in FIG. 8 is an approximate straight line of four coordinates in cases of being evaluated as "No jam" in TABLE 4, and an approximate expression of the straight line K7 as the mathematical expression 10 is calculated from these coordinates. Thus, the mathematical expression 10 is an expression representing a boundary of the presence or absence of occurrence of the jam in the transported fourth paper.

As shown in TABLE 4, in a case that the length X is 0.07 mm and the angle Y is 5 degrees, that the length X is 0.15 mm and the angle Y is 4 degrees, that the length X is 0.22 mm and the angle Y is 4 degrees, that the length X is 0.25 mm and the angle Y is 3 degrees, and that the length X is 0.29 mm and the angle Y is 3 degrees, the fourth paper is not dirty in each of the cases and each of the cases is evaluated as "No dirt". Noted that in the case that the length X is 0 mm and the angle Y is 2 degrees and that the length X is 0.04 mm and the angle Y is 3 degrees, each of the cases is evaluated as "No dirt". In the case that the length X is 0 mm and the angle Y is 3 degrees and that the length X is 0.04 mm and the angle Y is 4 degrees, the jam occurred in each of the cases and the evaluation of the dirt can not be performed in each of the cases. In a case that the length X is 0.07 mm and the angle Y is an angle of not more than 5 degrees, that the length X is 0.15 mm and the angle Y is an angle of not more than 4 degrees, that the length X is 0.22 mm and the angle Y is an angle of not more than 4 degrees, that the length X is 0.25 mm and the angle Y is an angle of not more than 3 degrees, and that the length X is 0.29 mm and the angle Y is an angle of not more than 3 degrees, each of the results is presumed as "No dirt". An evaluation method of the dirt for TABLE 4 is the same method as TABLE 1. Meanwhile, in a case that the length X is 0.07 mm and the angle Y is 6 degrees, that the length X is 0.15 mm and the angle Y is 5 degrees, that the length X is 0.22 mm and the angle Y is 5 degrees, that the length X is 0.25 mm and the angle Y is 4 degrees, and that the length X is 0.29 mm and the angle Y is 4 degrees, there is the dirt on the fourth paper in each of the cases and each of the results is evaluated as "Some dirt". Noted that, in a case that the length X is 0.07 mm and the angle Y is an angle of not less than 6 degrees, that the length X is 0.15 mm and the angle Y is an angle of not less than 5 degrees, that the length X is 0.22 mm and the angle Y is an angle of not less than 5 degrees, that the length X is 0.25 mm and the angle Y is an angle of not less than 4 degrees, and that the length X is 0.29 mm and the angle Y is an angle of not less than 4 degrees, each of the results is presumed as "Some dirt". The straight line K8 shown in FIG. 8 is an approximate straight line of five coordinates in cases of being evaluated as "No dirt" in TABLE 4, and an approximate expression of the straight line K8 as the mathematical expression 11 is calculated from these coordinates. Thus, the mathematical expression 11 is an expression representing a boundary of the presence or absence of occurrence of the dirt in the transported fourth paper. In the graph of FIG. 8, the mathematical expressions 2 and 5 indicate lower limits of the length X of the front end surface 77 and the angle Y of the driven spur 71.

The area U4K surrounded by the mathematical expressions 2, 5 and the mathematical expressions 10, 11 is an area in which the occurrence of jam and dirt is suppressed at the time of transporting the fourth paper. Therefore, by setting the length X of the front end surface 77 of the driven spur 71 and the angle Y of the driven spur 71 within this area, it is possible to suppress the occurrence of both the jam and the dirt.

Figure 9A:
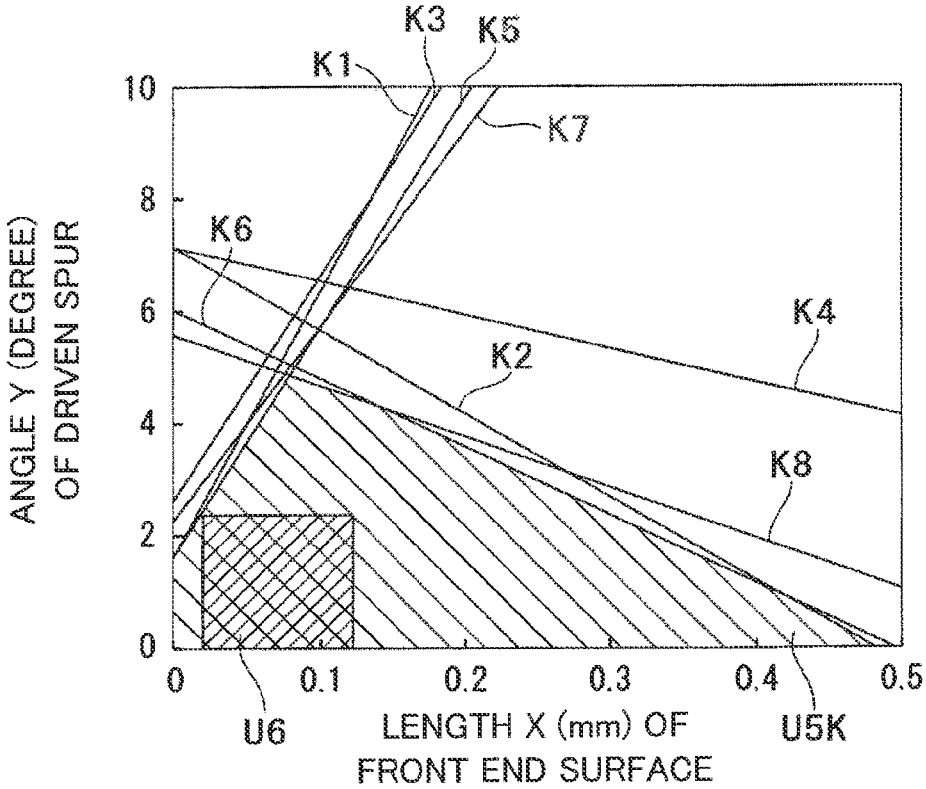
FIG. 9A is a graph in which two straight lines shown in FIG. 5, two straight lines shown in FIG. 6, two straight lines shown in FIG. 7, and two straight lines shown in FIG. 8 are drawn and an overlapped area of four areas is shown.

Next, the area U5K will be explained. The area (first area) U5K is an area which is surrounded by X-axis, Y-axis, and four straight lines K2, K5, K6, K8 shown in FIG. 9A and an overlapped area of four areas including U1K, U2K, U3K, and U4K. Similar to FIG. 5, the length X (mm) of the front end surface 77 is the horizontal axis and the angle Y (degree) is the vertical axis in FIG. 9A. The length X (mm) of the front end surface 77 of each tooth 72*a* of the driven spur 71 is 0.07 mm and the angle Y is 1.2 degrees in this embodiment. That is, the length X of the front end surface and the angle Y of the driven spur 71 are within the area U5K as shown in FIG. 9A. Accordingly, even when any of different types of the first to fourth paper is transported, it is possible to suppress the occurrence of both the jam of the paper and the dirt on the paper.

Further, as shown in FIG. 9A, the length X of the front end surface and the angle Y of the driven spur 71 are within an area U6 included in the area U5K. The length X of the front end surface in the area U6 is not less than 0.02 mm and not more than 0.12 mm, and the angle Y of the driven spur 71 in the area U6 is more than 0 degrees and not more than 2.4 degrees. Thus, even when any of the different types of first to fourth paper is transported, it is possible to further suppress the occurrence of both the jam and the dirt. The angle Y of the driven spur 71 has an attachment error of plus or minus 1.2 degrees. In a case that the angle Y of the driven spur 71 is less than 0 degrees, the paper P is not allowed to abut against the guide surface 54*a* and the positioning function is reduced. Therefore, the angle Y is preferably more than 0 degrees and not more than 2.4 degrees.

Those shown in FIGS. 5 to 8, and FIG. 9B are areas U1Q, U2Q, U3Q, U4Q, and U5Q. The area U1Q is an area which is surrounded by X-axis, Y-axis, and two straight lines Q1, Q2 shown in FIG. 5 and is surrounded by the mathematical expressions 1, 2 and mathematical expressions 12, 13 given below in the graph of FIG. 5.

The mathematical expression 12 is "Y=46.7X+1.0", and the mathematical expression 13 is "Y=−16.7X+7.2".

In FIG. 5, the straight line Q1 is a straight line which passes through two coordinates, of three coordinates positioned on the right side (No jam side) of the straight line K1, which are separated farther from the straight line K1. The straight line Q1 is shown by a broken line in FIG. 5. Then, the mathematical expression 12 is calculated from the straight line Q1. In FIG. 5, the straight line Q2 is a straight line which passes through two coordinates positioned on the left side (No dirt side) of the straight line K2. The straight line Q2 is shown by a broken line in FIG. 5. Then, the mathematical expression 13 is calculated from the straight line Q2. Accordingly, the area U1Q is narrower than the area U1K. Therefore, by setting the length X of the front end surface 77 of the driven spur 71 and the angle Y of the driven spur 71 within the area U1Q, it is possible to further suppress the occurrence of both the jam of the first paper and the dirt on the first paper.

The area U2Q is an area which is surrounded by X-axis, Y-axis, and two straight lines Q3, Q4 shown in FIG. 6 and is surrounded by the mathematical expressions 2, 5 and mathematical expressions 14, 15 given below in the graph of FIG. 6.

The mathematical expression 14 is "Y=40.0X+2.0", and the mathematical expression 15 is "Y=−7.1X+7.1".

In FIG. 6, the straight line Q3 is a straight line which passes through two coordinates, of three coordinates positioned on the right side (No jam side) of the straight line K3, which are separated farther from the straight line K3. The straight line Q3 is shown by a broken line in FIG. 6. Then, the mathematical expression 14 is calculated from the straight line Q3. In FIG. 6, the straight line Q4 is a straight line which passes through two coordinates positioned on the left side (No dirt side) of the straight line K4. The straight line Q4 is shown by a broken line in FIG. 6. Then, the mathematical expression 15 is calculated from the straight line Q4. Accordingly, the area U2Q is narrower than the area U2K. Therefore, by setting the length X of the front end surface 77 of the driven spur 71 and the angle Y of the driven spur 71 within the area U2Q, it is possible to further suppress the occurrence of both the jam of the second paper and the dirt on the second paper.

The area U3Q is an area which is surrounded by X-axis, Y-axis, and two straight lines Q5, Q6 shown in FIG. 7 and is surrounded by the mathematical expressions 1, 2 and mathematical expressions 16, 17 given below in the graph of FIG. 7.

The mathematical expression 16 is "Y=40.0X+1.0", and the mathematical expression 17 is "Y=−13.6X+6.0".

In FIG. 7, the straight line Q5 is a straight line which passes through two coordinates, of three coordinates positioned on the right side (No jam side) of the straight line K5, which are separated farther from the straight line K5. The straight line Q5 is shown by a broken line in FIG. 7. Then, the mathematical expression 16 is calculated from the straight line Q5. In FIG. 7, the straight line Q6 is a straight line which passes through two coordinates, of three coordinates positioned on the left side (No dirt side) of the straight line K6, which are separated farther from the straight line K6. The straight line Q6 is shown by a broken line in FIG. 7. Then, the mathematical expression 17 is calculated from the straight line Q6. Accordingly, the area U3Q is narrower than the area U3K. Therefore, by setting the length X of the front end surface 77 of the driven spur 71 and the angle Y of the driven spur 71 within the area U3Q, it is possible to further suppress the occurrence of both the jam of the third paper and the dirt on the third paper.

The area U4Q is an area which is surrounded by X-axis, Y-axis, and two straight lines Q7, Q8 shown in FIG. 8 and is surrounded by the mathematical expressions 2, 5 and mathematical expressions 18, 19 given below in the graph of FIG. 8.

The mathematical expression 18 is "Y=36.4X+1.5", and the mathematical expression 19 is "Y=−10.0X+5.5".

In FIG. 8, the straight line Q7 is a straight line which passes through two coordinates, of three coordinates positioned on the right side (No jam side) of the straight line K7, which are separated farther from the straight line K7. The straight line Q7 is shown by a broken line in FIG. 8. Then, the mathematical expression 18 is calculated from the straight line Q7. In FIG. 8, the straight line Q8 is a straight line which passes through two coordinates positioned on the left side (No dirt side) of the straight line K8. The straight line Q8 is shown by a broken line in FIG. 8. Then, the mathematical expression 19 is calculated from the straight line Q8. Accordingly, the area U4Q is narrower than the area U4K. Therefore, by setting the length X of the front end surface 77 of the driven spur 71 and the angle Y of the driven spur 71 within the area U4Q, it is possible to further suppress the occurrence of both the jam of the fourth paper and the dirt on the fourth paper.

Figure 9B:
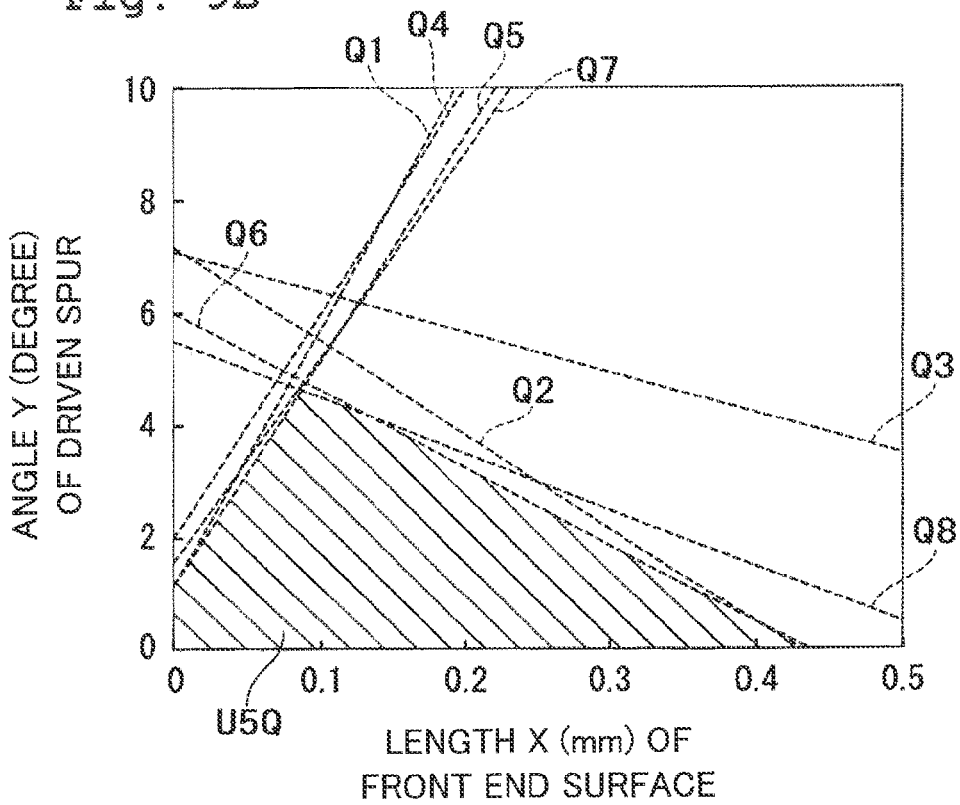
FIG. 9B is a graph in which two broken lines shown in FIG. 5, two broken lines shown in FIG. 6, two broken lines shown in FIG. 7, and two broken lines shown in FIG. 8 are drawn and an overlapped area of four areas is shown.

The area U5Q (second area) is an area which is surrounded by X-axis, Y-axis, and four straight lines Q2, Q5, Q6, Q8 shown in FIG. 9B and an overlapped area of four areas including U1Q, U2Q, U3Q, and U4Q. Similar to FIG. 5, the length X (mm) of the front end surface 77 is the horizontal axis and the angle Y (degree) is the vertical axis in FIG. 9B. As described above, the length X (mm) of the front end surface 77 of each tooth 72*a* of the driven spur 71 is 0.07 mm and the angle Y is 1.2 degrees in this embodiment. That is, the length X of the front end surface and the angle Y of the driven spur 71 are within the area U5Q as shown in FIG. 9B. The area U5Q is narrower than the area U5K. Therefore, by setting the length X of the front end surface 77 of the driven spur 71 and the angle Y within the area U5Q, it is possible to further suppress the occurrence of both the jam of the paper and the dirt on the paper as compared with the area U5K.

Figures 10A, 10B, 10C, 10D:
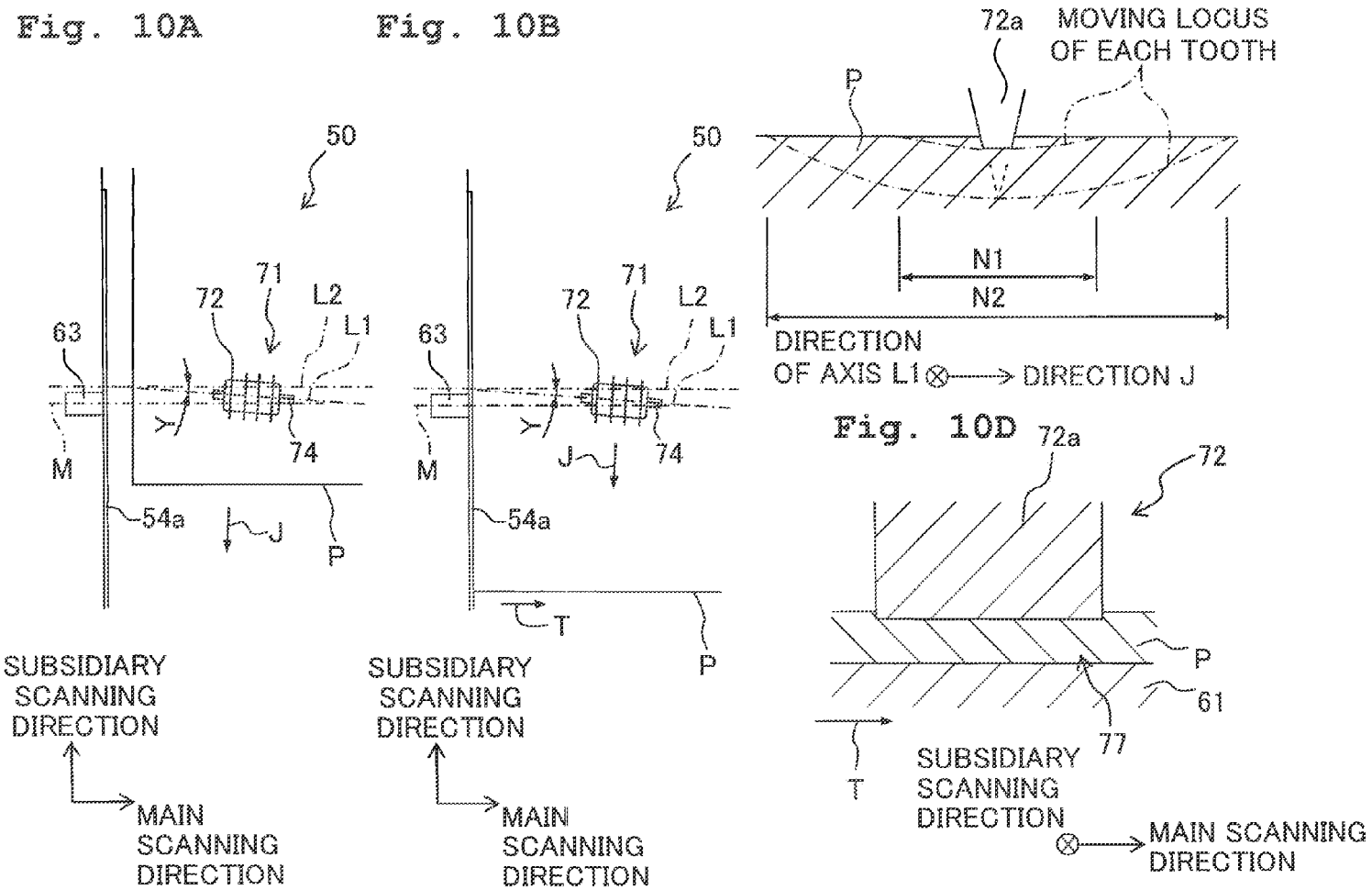

Next, an explanation will be made below about the positioning operation for the paper P performed by the positioning mechanism 50 while referring to FIG. 10. FIG. 10C is a partial cross-sectional view of the paper P and the tooth 72*a* as viewed from the direction of the axis L1, and FIG. 10D is a partial cross-sectional view of the paper P and the tooth 72*a* as viewed from a direction opposite to the transport direction E.

At first, the paper P is transported to the positioning mechanism 50 by the transport roller pair 47. In a case that the forward end of the paper P arrives at the driving roller 61 and the driven spur 71 as shown in FIG. 10A, the paper P is transported in a direction J by the driving roller 61. That is, a rotation direction of the driven spur 71 at a point at which the driven spur 71 makes contact with the paper P is a direction perpendicular to the axis L, and thus the paper P is transported in the direction J to approach the guide surface 54*a*. Then, one side end, of the paper P, on a side closer to the guide surface 54*a* makes contact with the guide surface 54*a*. Accordingly, as shown in FIG. 10B, the paper P is entirely drawn to or comes entirely closer to the guide surface 54*a*.

The paper P is continued to be transported in the direction J so as to be drawn to the guide surface 54*a* after the contact with the guide surface 54*a*. In this situation, the contact of the paper P with the guide surface 54*a* causes a reactive force in a direction T (direction away from the guide surface 54*a*) which acts on a portion, of the paper P, making contact with the tooth 72*a* of the spur 72. The reactive force in the direction T increases, as the amount of sticking of the tooth 72*a* of the spur 72 with respect to the paper P increases, under the condition that the angle Y of the driven spur 71 is the same. The tooth 72*a* of the spur 72 in this embodiment has the front end surface 77, and thus the tooth 72*a* is less likely to stick in the paper P. As shown in FIG. 10C, a distance which causes the tooth 72*a* to make contact with the paper P while the tooth 72*a* rotates one revolution is a distance N1 in this embodiment. Meanwhile, the tooth having a sharp tooth tip shown by alternate long and two short dashes lines in FIG. 10C has the amount of the sticking in the paper P which is larger than that of the tooth 72*a*. A distance which causes the sharp tooth to make contact with the paper P while the sharp tooth rotates one revolution is a distance N2. Then, as shown in FIG. 10C, the distance N2 which causes the sharp tooth (shown by alternate long and two short dashes lines in FIG. 10C) to make contact with the paper P while the sharp tooth rotates one revolution, the sharp tooth having the larger amount of sticking of the tooth with respect to the paper P, is longer than the distance N1 in the case of the tooth 72*a*. Therefore, a distance, in the main scanning direction, which causes the tooth to approach the guide surface 54*a* while the tooth is brought in contact with the paper P, becomes long. As a result, the reactive force in the direction T exerted on each tooth also increases. In this embodiment, however, since the tooth 72*a* is less likely to stick in the paper P, the distance which causes each tooth 72*a* to make contact with the paper P while the tooth 72*a* rotates one revolution is shorter than the distance in the case of the sharp tooth. That is, with respect to the tooth 72*a*, the distance, in the main scanning direction, which causes the tooth 72*a* to approach the guide surface 54*a* while the tooth 72*a* is brought in contact with the paper P is short, and further the reactive force in the direction T is also small. Further, when the front end surface 77 is formed in each tooth 72*a* of each spur 72, since the distance which causes the tooth 72*a* to approach the guide surface 54*a* while the tooth 72*a* is brought in contact with the paper P is shorter than the distance in the case of the sharp tooth, even when the paper P is moved in the direction T relative to each tooth 72*a* as will be described later on, the distance of relative movement is short. As a result, the ink, which is rubbed on the paper P from each tooth 72*a*, is reduced, and thereby making it possible to suppress the dirt on the paper P.

In a case that the angle Y of the driven spur 71 is within the area U5K, an upper limit thereof is regulated. On the other hand, in a case that the angle Y exceeds the area U5K, the distance, in the main scanning direction, which causes the tooth 72*a* to approach the guide surface 54*a* while the tooth 72*a* is brought in contact with the paper P, is long. Then, even when the tooth 72*a* has the front end surface 77, the distance of the relative movement of when the paper P is moved in the direction T relative to the tooth 72*a* is long. As a result, the ink rubbed on the paper P from the tooth 72*a* is increased, which makes the paper P dirty. Further, in the case that the angle Y exceeds the area U5K, the movement amount of the paper P to approach the guide surface 54*a* is too large and thereby the paper P is bent between the driven spur 71 and the guide surface 54*a* in some cases. Furthermore, the reactive force in the direction T also increases. Then, a rotational load of the driven spur 71 increases, which causes a feed error of the paper. The jam of the paper P is caused by at least any of the above undesired matters. In this embodiment, however, by setting the angle Y of the drive spur 71 within the area U5K (area U6), even when the paper P is moved in the direction T relative to the tooth 72*a*, the distance of relative movement is short and the dirt on the paper P can be suppressed. In addition to this, the movement amount of the paper P to approach the guide surface 54*a* is also reduced, and thereby the paper P is less likely to be bent between the driven spur 71 and the guide surface 54*a*. Further, the reactive force in the direction T is also reduced, the rotational load of the driven spur 71 is reduced. Accordingly, the occurrence of jam can be suppressed.

The driven spur 71 makes contact with the paper P as follows. That is, the front end surface 77 of each tooth 72*a* sequentially makes contact with the paper P while the driven spur 71 is rotated in association with the transport of the paper P. A contact area of the driven spur 71 with the paper P corresponds to the front end surface 77 of each tooth 72*a*, and thus the contact area of the driven spur 71 with the paper P is considerably smaller than that of a feeding runner having an outer circumferential surface in a columnar shape. Therefore, even when the ink is adhered to the front end surface 77 owing to the contact between the front end surface 77 and the image, since the front end surface 77 itself is small, the amount of the ink transferred to the paper P is also small. In other words, the ink transferred to the paper P is more likely to be reduced, as the contact area with the paper P is smaller. As a result, the ink is less likely to be transferred to the paper P from the driven spur 71 and the dirt on the paper P can be suppressed.

Further, since the tooth 72*a* is less likely to stick in the paper P, force for restricting the relative movement of the paper P in the direction T relative to the tooth 72*a* is also reduced. Thus, even when the reactive force in the direction T acts on the paper P, since the paper P is moved in the direction T relative to the tooth 72*a*, the reactive force in the direction T exerted on the paper P can be allowed to escape. If the reactive force in the direction T can not be allowed to escape, the reactive force becomes a heavy rotational load on the driven spur and the feed error of the paper P may arise in some cases. Further, in the case that the reactive force in the direction T can not be allowed to escape, the paper P is held such that the paper P can not be moved in the direction T relative to each tooth of the driven spur. Then, the paper P is continuously transported toward the guide surface 54*a*, so that the paper P is bent between the driven spur 71 and the guide surface 54*a* in some cases. The jam of the paper P is caused by at least any of the above undesired matters. In this embodiment, however, the front end surface 77 is formed in each tooth 72 of each spur 72, and thus the force in the direction T can be allowed to escape as compared with the case of each tooth having the sharp tooth tip. Therefore, the jam of the paper P can be suppressed.

As described above, in a case that the paper P is transported, the paper P is transported by the driving roller 61 and the driven spur 71 to be drawn to the side of the guide surface 54*a*, even when the paper P is brought in contact with the guide surface 54*a*. Since the length X of the front end surface 77 and the angle Y of the driven spur 71 are within the area U5K (area U5Q or area U6), the paper P can be transported in the transport direction E while suppressing the occurrence of the jam and the dirt. Accordingly, it is performed the positioning of the paper P in the main scanning direction.

According to the printer 1 of this embodiment, the driven spur 71 includes the spurs 72, each of which has the teeth 72*a* having the front end surfaces 77 respectively. When the driven spur 71 is inclined so that the paper P is drawn to the guide surface 54*a*, the length X of the front end surface 77 and the angle Y of the driven spur 71 are configured to be within the area U5K. Accordingly, for example, in a case that any of the different types of first to fourth paper is transported as the paper P, it is possible to suppress the occurrence of both the jam of the paper P and the dirt on the paper P.

The preferred embodiment of the present teaching has been explained above. However, the present teaching is not limited to the embodiment described above, for which various changes can be made within a range of definition of claims. For example, in the above embodiment, the length X of the front end surface 77 of the tooth 72*a* of the driven spur 71 and the angle Y of the driven spur 71 are within the area U6. However, they may be within the area U5K or U5Q other than the area U6. The front end surface 77 in the above embodiment may be formed by etching, machine processing, or the like. The etching may be double-sided etching or single-sided etching including single-sided half etching. In a case that the front end surface 77 is formed by the etching, the front end surface 77 may have a curved surface which is concave toward the side of the axis L1. Further, the front end surface 77 may have a convex shape which is convex in a direction away from the axis L1.

In the above embodiment, the driven spur 71 includes the four spurs 72. However, the number of spurs 72 may be 1, 2, 3, or 5 or more. The positioning mechanism 50 may be provided in the downstream guide section 3*b*. Accordingly, the paper P is discharged to the paper discharge section 4 in a state of being positioned.

The present teaching is applicable to any of the line type and the serial type. Further, the present teaching is also applicable to the facsimile, the copying machine, or the like, without being limited to the printer. Further, the present teaching is applicable to any recording apparatus including, for example, those of the laser type and the thermal type provided that the recording apparatus records the image. The recording medium is not limited to the paper P, and the recording medium may be various media capable of performing the recording thereon.

What is claimed is:

1. A recording apparatus comprising:

a recording section configured to discharge the liquid; and a transport mechanism configured to transport the recording medium for which an image is recorded by the liquid discharged from the recording section, the transport mechanism including:

a guide surface extending linearly and configured to guide one of both side ends of the recording medium transported;

a driving roller configured to make contact with a surface, of the recording medium, on which no image is recorded and transport the recording medium; and a driven spur configured to make contact with a surface, of the recording medium, on which the image is recorded so that the recording medium is nipped between the driven spur and the driving roller, and including at least one spur which is configured to rotate in association with the transport of the recording medium by rotation of the driving roller, wherein each of the at least one spur includes a plurality of teeth protruding in a first direction, which is perpendicular to an axis of a rotational shaft of the driven spur as viewed from a direction of the axis, and arranged in a circumferential direction with the axis of the driven spur;

each of the teeth includes two side surfaces and a front end surface, each of the two side surfaces inclining to come closer to an imaginary line perpendicular to the axis from a base to a tip of each of the teeth, as viewed from the direction of the axis, the front end surface being formed at a position closer to the axis than a line of intersection of two imaginary planes extending along the two side surfaces; and in a graph, in which a length X (mm) of the front end surface in a second direction, which is an in-plane direction of the front end surface and is perpendicular to both of the direction of the axis and the first direction, is a horizontal axis and an angle Y (degree) between the axis and the imaginary line perpendicular to the guide surface passing through a point of intersection between the axis and the guide surface is a vertical axis, the length X of the front end surface of the driven spur and the angle Y of the driven spur are configured to be within a first area surrounded by mathematical expressions 1 to 6:

wherein

| | |
|---|---|
| $X>0$, | a mathematical expression 1: |
| $Y>0$, | a mathematical expression 2: |
| $Y=40.1X+1.6$, | a mathematical expression 3: |
| $Y=-9.0X+5.6$, | a mathematical expression 4: |
| $Y=-12.1X+6.0$, and | a mathematical expression 5: |
| $Y=-14.7X+7.1$. | a mathematical expression 6: |

2. The recording apparatus according to claim 1, wherein the length X of the front end surface of the driven spur and the angle Y of the driven spur are configured to be within a second area, which is included in the first area and is surrounded by mathematical expressions 1, 2 and 7 to 10, wherein $Y=40.0X+1.0$, a mathematical expression 7:

$Y=-10.0X+5.5$, a mathematical expression 8:

$Y=-13.6X+6.0$, and a mathematical expression 9:

$Y=-16.7X+7.2$. a mathematical expression 10:

3. The recording apparatus according to claim 1, wherein the length X of the front end surface of the driven spur is not less than 0.02 mm and not more than 0.12 mm; and the angle Y of the driven spur is more than 0 degrees and not more than 2.4 degrees.

4. A recording apparatus comprising:

a recording section configured to discharge the liquid; and a transport mechanism configured to transport the recording medium for which an image is recorded by the liquid discharged from the recording section, the transport mechanism including:

a guide surface extending linearly and configured to guide one of both side ends of the recording medium transported;

a driving roller configured to make contact with a surface, of the recording medium, on which no image is recorded and transport the recording medium; and a driven spur configured to make contact with a surface, of the recording medium, on which the image is recorded so that the recording medium is nipped between the driven spur and the driving roller, and including at least one spur which is configured to rotate in association with the transport of the recording medium by rotation of the driving roller, wherein each of the at least one spur includes a plurality of teeth protruding in a first direction, which is perpendicular to an axis of a rotational shaft of the driven spur as viewed from a direction of the axis, and arranged in a circumferential direction with the axis of the driven spur;

each of the teeth includes two side surfaces and a front end surface, each of the two side surfaces inclining to come closer to an imaginary line perpendicular to the axis from a base to a tip of each of the teeth, as viewed from the direction of the axis, the front end surface being formed at a position closer to the axis than a line of intersection of two imaginary planes extending along the two side surfaces;

a length X, in a second direction, of the front end surface of the driven spur is more than 0 mm and not more than 0.6 mm, wherein the second direction is an in-plane direction of the front end surface and is perpendicular to both of the direction of the axis and the first direction; and an angle Y of the driven spur is more than 0 degrees and not more than 4.6 degrees, wherein the angle Y is an angle between the axis and the imaginary line perpendicular to the guide surface passing through a point of intersection between the axis and the guide surface.

5. The recording apparatus according to claim 4, wherein the length X of the front end surface of the driven spur is not less than 0.02 mm and not more than 0.12 mm; and the angle Y of the driven spur is more than 0 degrees and not more than 2.4 degrees.

* * * * *